US006199972B1

(12) United States Patent
Ishinaga et al.

(10) Patent No.: US 6,199,972 B1
(45) Date of Patent: Mar. 13, 2001

(54) LIQUID DISCHARGING METHOD, LIQUID DISCHARGING HEAD, AND HEAD CARTRIDGE AND LIQUID DISCHARGING APPARATUS USING SAID LIQUID DISCHARGING HEAD

(75) Inventors: Hiroyuki Ishinaga, Tokyo; Toshio Kashino, Chigasaki; Yoichi Taneya, Yokohama; Hiroyuki Sugiyama, Sagamihara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/123,332

(22) Filed: Jul. 28, 1998

(30) Foreign Application Priority Data

Jul. 31, 1997 (JP) ..... 9-206548

(51) Int. Cl.[7] ..... B41J 2/05
(52) U.S. Cl. ..... 347/65
(58) Field of Search ..... 347/65, 67, 15, 347/92, 63

(56) References Cited

U.S. PATENT DOCUMENTS

| | | | | |
|---|---|---|---|---|
| 4,723,129 | | 2/1988 | Endo et al. | 346/1.1 |
| 5,457,485 | * | 10/1995 | Moriyama et al. | 347/92 |
| 5,821,962 | * | 10/1998 | Kudo et al. | 347/65 |

FOREIGN PATENT DOCUMENTS

| | | |
|---|---|---|
| 0 436 047 | 7/1991 | (EP) . |
| 0 737 581 | 10/1996 | (EP) . |
| 0 738 600 | 10/1996 | (EP) . |
| 0 765 750 | 4/1997 | (EP) . |
| 0 811 489 | 12/1997 | (EP) . |
| 63-151459 | 6/1988 | (JP) . |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

This specification discloses a liquid discharging method of discharging liquid from a discharge port for discharging the liquid by a liquid discharging element in a first liquid flow path communicating with the discharge port for supplying the liquid to the discharge port, characterized by the use of a variable member for causing negative pressure to act on the first liquid flow path. The specification also discloses a liquid discharging head having a discharge port for discharging liquid therethrough, a first bubble creating area for creating a first bubble in the liquid, and a first liquid flow path provided with the first bubble creating area and communicating with the discharge port, the liquid in the first liquid flow path being discharged through the discharge port by the creation of the first bubble, characterized by a second bubble creating area for creating a second bubble in the liquid, a second liquid flow path provided with the second bubble creating area, and negative pressure acting means using a variable member provided between the first liquid flow path and the second liquid flow path for causing only negative pressure to act in the first liquid flow path by the disappearance of the second bubble. The specification also discloses a head cartridge and a liquid discharging apparatus using such liquid discharging head.

17 Claims, 21 Drawing Sheets t0
t1
t2
t3
t4
t5
(μs)

t0
t1
t2 t1
t2
t3
t4
t5

LIQUID DISCHARGING METHOD, LIQUID DISCHARGING HEAD, AND HEAD CARTRIDGE AND LIQUID DISCHARGING APPARATUS USING SAID LIQUID DISCHARGING HEAD

BACKGROUND OF THE INVENTION

1. Field of the Invention

This invention relates to a liquid discharging head having a movable member displaceable by the utilization of the creation of a bubble occurring by heat energy being caused to act on liquid, a head cartridge, a liquid discharging apparatus and a liquid discharging method using the liquid discharging head.

Particularly, the present invention relates to a liquid discharging head for controlling the discharge state of liquid by a movable member displaceable by pressure resulting from the disappearance of a bubble, a head cartridge, a liquid discharging apparatus and a liquid discharging method using the liquid discharging head.

2. Related Background Art

As a method of steeply varying the pressure in a liquid flow path having a discharge port for discharging liquid therethrough to thereby discharge the liquid in the liquid flow path through the discharge port, there is known a bubble jet recording method of giving energy such as heat to liquid to thereby cause a state change accompanied by a steep volume change (the creation of a bubble) in the liquid, and discharging the liquid from a discharge port by an action force based on this state change, and causing the liquid to adhere to a recording medium to thereby effect image formation. In a recording apparatus using this bubble jet recording method, as disclosed in U.S. Pat. No. 4,723,129, etc., there are generally disposed a discharge port for discharging liquid, a liquid flow path communicating with this discharge port, and an electrothermal converting member as energy generating means for discharging liquid disposed in the liquid flow path.

According to such a liquid discharging method, images of high dignity can be recorded at a high speed and with low noise, and in a head carrying out this liquid discharging method, discharge ports for discharging the liquid can be disposed highly densely, and this leads to many excellent advantages that recorded images of high resolution and further, colored images can be easily obtained by a compact apparatus. Therefore, in recent years, this bubble jet recording method has been utilized in many office machines such as printers, copying apparatuses and facsimile apparatuses, and has further come to be utilized even in an industrial system such as a textile printing apparatus.

Also, in such a liquid discharging method, the condition for driving the electrothermal converting member is a simple rectangular pulse, and this leads to the feature that there is obtained a very stable discharging state.

On the other hand, as another liquid discharging method, there is known a piezo system whereby electricity is applied to a piezoelectric element and the deformation thereof is utilized to discharge liquid from a discharge port.

In such a liquid discharging method, the volume of a nozzle storing liquid therein can be changed to both an increase side and a decrease side and therefore, depending on the driving condition of the piezoelectric element, it is possible to change the discharge state of the liquid.

Now, in recent years, gradation recording in which the discharge amount is variably controlled has been effected with a view to improve the quality of image. However, if an attempt is made to variably control the discharge amount in the prior-art liquid discharging method as described above, the driving condition and circuit become complicated and the mechanical reaction after the operation of the piezoelectric element necessarily occurs, and this adversely affects the discharge. Therefore, in such a liquid discharging method, control for repeating a stable discharge state must be effected, and this leads to the problem that the control method becomes complicated.

Particularly, the influence of this reaction is great in an operation which is not accompanied by discharge and therefore, it is practically impossible to effect the control as described above. Further, in the piezoelectric element itself, the structure thereof is complicated and the amount of displacement thereof is small and therefore, to discharge the liquid, it is necessary to make the area of the piezoelectric element relative to the liquid flow path large, and this is impossible to realize in a system wherein parts are disposed highly densely as in the bubble jet system.

SUMMARY OF THE INVENTION

The present invention intends to realize a highly dense arrangement which could not be provided from the above-described prior-art liquid discharging method and yet achieve the control of the discharge state by a very simple circuit and driving method, and the main objects thereof are as follows.

A first object of the present invention is to provide a liquid discharging head and method which can realize a highly dense nozzle arrangement and yet can achieve the stabilization of the discharge state.

A second object of the present invention is to provide a liquid discharging head and method which can realize a highly dense nozzle arrangement and yet can variably control the discharge amount.

A third object of the present invention is to provide a liquid discharging head and method which can realize a highly dense nozzle arrangement and yet make the multi-stage harmony of the discharge amount possible.

To achieve the above objects, the present invention is a liquid discharging method of discharging liquid from a discharge port for discharging liquid by a liquid discharging element in a first liquid flow path communicating with the discharge port and supplying the liquid to the discharge port, characterized by the use of a variable member for causing negative pressure to act on the first liquid flow path.

Also, it is characterized in that provision is made of a movable member displaceable relative to the first liquid flow path only by the disappearance of a bubble, and the negative pressure is caused to act by the displacement of the movable member.

Also, it is characterized in that the movable member is displaced away from the first liquid flow path by the disappearance of the bubble.

Also, it is characterized in that the movable member is a movable valve having a free end at the discharge port side.

Also, it is characterized in that the movable member is movable film constituting a part of the flow path wall of the first liquid flow path.

Also, it is characterized in that the movable member is displaced at predetermined timing.

Also, it is characterized in that the movable member is displaced in a state in which the liquid is discharged from the discharge port.

Also, it is characterized in that the movable member is displaced on the basis of the displacement of the meniscus of the liquid in the discharge port.

Also, it is characterized in that detecting means for detecting the presence or absence of the liquid is provided near the discharge port, and the detection result in a state in which the movable member is not displaced and the detection result in a state in which the movable member is displaced are compared with each other to thereby detect the state of the liquid.

Also, the present invention is a liquid discharging head having:

a discharge port for discharging liquid therefrom;

a first bubble creating area for creating a first bubble in the liquid; and a first liquid flow path provided with the first bubble creating area and communicating with the discharge port;

the liquid discharging head discharging the liquid in the first liquid flow path from the discharge port by the creation of the first bubble, characterized by:

a second bubble creating area for creating a second bubble in the liquid;

a second liquid flow path provided with the second bubble creating area; and negative pressure acting means provided between the first liquid flow path and the second liquid flow path and using a variable member for causing only negative pressure to act in the first liquid flow path by the disappearance of the second bubble.

Also, it is characterized in that the negative pressure acting means is displaced away from the first liquid flow path by the disappearance of the second bubble.

Also, it is characterized in that the negative pressure acting means is a movable valve having a free end at the discharge port side.

Also, it is characterized in that the movable member is movable film constituting a part of the flow path wall of the first liquid flow path.

Also, it is characterized in that the second bubble creating area and the negative pressure acting means are provided upstream of the first bubble creating area.

Also, it is characterized in that the second bubble creating area, the negative pressure acting means and the first bubble creating area are disposed laterally relative to the direction of flow of the liquid.

Also, it is characterized by a liquid container for holding therein the liquid to be supplied to the liquid discharging head.

Also, it is characterized in that the liquid discharging head and the liquid container are separable from each other.

Also, it is characterized in that the liquid container can be refilled with the liquid.

Also, it is characterized by driving signal supplying means for supplying a driving signal for causing the liquid to be discharged from the liquid discharge port.

Also, it is characterized by recording medium conveying means for conveying a recording medium receiving the liquid discharged from the liquid discharging head.

The liquid discharging element may be a piezoelectric element or the like, besides an element for creating a bubble in the liquid as will be described in the following embodiments to thereby discharge the liquid.

In the present invention constructed as described above, a second bubble is first created in the second bubble creating area, whereafter the created second bubble is caused to disappear, whereupon with the disappearance of the second bubble, the negative pressure acting means is displaced away from the first liquid flow path. Thereby, negative pressure acts on the first liquid flow path and the meniscus in the discharge port retreats. When the meniscus in the discharge port retreats, the distance between a first bubble created to discharge the liquid and the meniscus becomes shorter. That is, the amount of liquid present between the first bubble and the meniscus becomes smaller and the amount of liquid discharged from the discharge port decreases. By the use of this mechanism, the amount of liquid discharged from the discharge port is controlled by the negative pressure acting means.

Also, if on the basis of the displacement of the meniscus, negative pressure is caused to act in the first liquid flow path by the negative pressure acting means, there can be realized a stable discharge state free of overshooting.

Also, if detecting means for detecting the presence of the liquid is provided near the discharge port so as to detect the state of the liquid by comparing the result of detection in a state in which the movable member is not displaced and the result of detection in a state in which the movable member is displaced with each other, the state of the liquid can be detected with good accuracy.

DESCRIPTION OF THE PREFERRED EMBODIMENTS

Some embodiments of the present invention will hereinafter be described with reference to the drawings.

(First Embodiment)

Figure 1A:
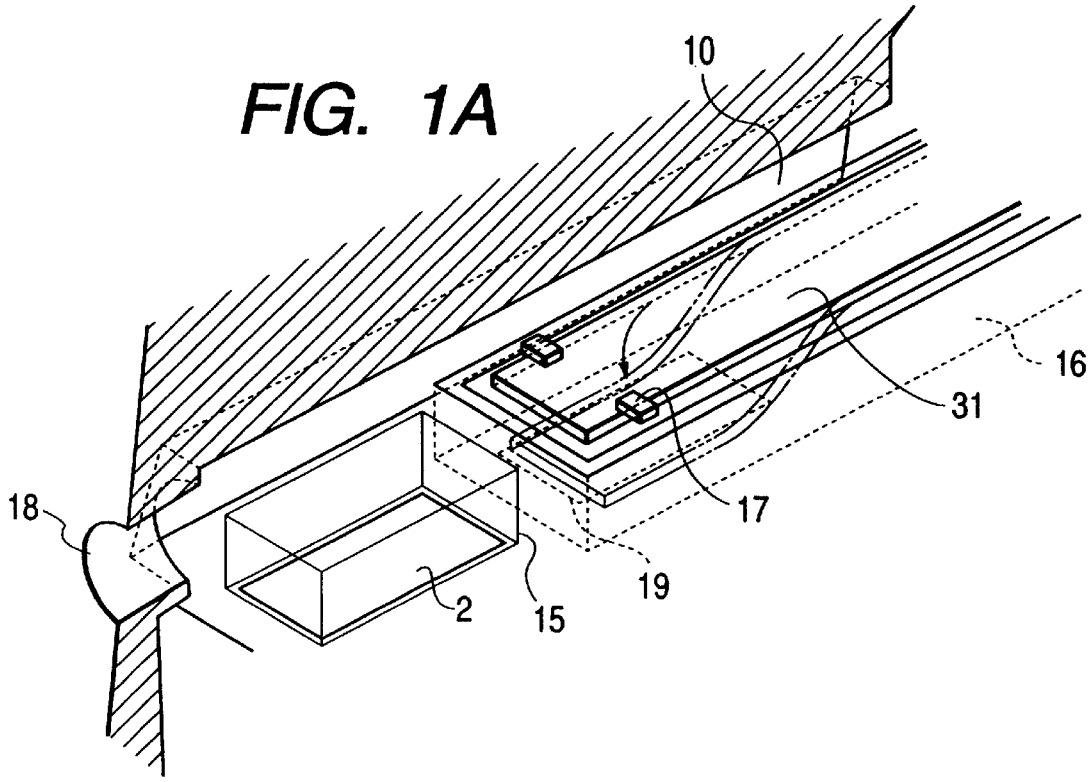
FIGS. 1A, 1B and 1C show a first embodiment of the liquid discharging head of the present invention, FIG. 1A being a schematic perspective view, FIG. 1B being a seen-through view, and FIG. 1C being a cross-sectional view taken along the line 1C—1C of FIG. 1B.
Figure 1B:
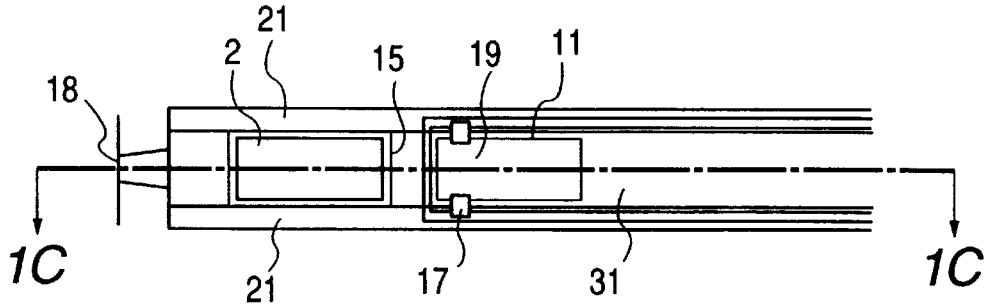
Figure 1C:
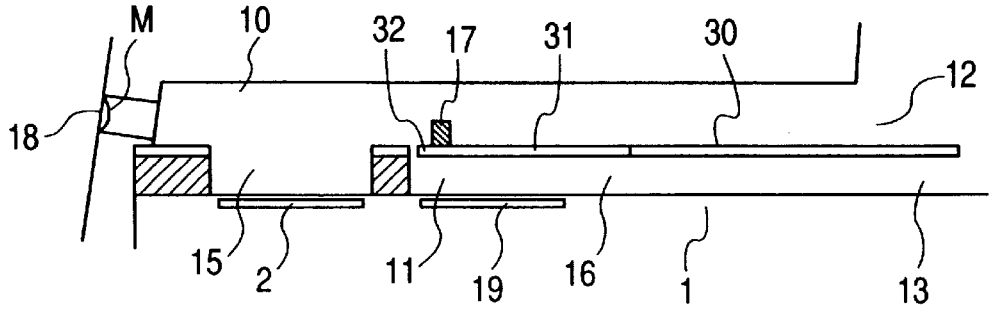

FIGS. 1A to 1C show a first embodiment of the liquid discharging head of the present invention, FIG. 1A being a schematic perspective view, FIG. 1B being a top seen-through view, and FIG. 1C being a cross-sectional view taken along the line 1C—1C of FIG. 1B.

As shown in FIGS. 1A to 1C, in the liquid discharging head of the present embodiment, a first heat generating member 2 (in the present embodiment, a heat generating resistance member of a shape of 40 $\mu$m×100 $\mu$m) for causing heat energy to act on liquid as a discharge energy generating element for discharging the liquid is provided on an element substrate 1, and on this element substrate 1, a first liquid flow path 10 is disposed correspondingly to the heat generating member 2. In the first liquid flow path 10, there is formed a first bubble creating area 15 for heating the liquid in the flow path by the heat generating member 2, and creating a bubble by a film boiling phenomenon, and with the creation-of the bubble in the bubble creating area 15, part of the liquid in the first liquid flow path 10 is discharged from a discharge port 18. Also, at the upstream side (liquid supply side) of the heat generating member 2, there is disposed a retraction type movable valve 31 of which the free end 32 is not operated toward the first liquid flow path 10 side by a displacement stopper 17 and is operable substantially only toward the element substrate 1, and the flow path is separated into the first liquid flow path 10 and a second liquid flow path 16 by the retraction type movable valve 31 and a separating wall 30. Particularly, in the present embodiment, the side portion of the retraction type movable valve 31 overlaps a flow path wall 21 and enhances the effect as a stopper and also enhances the effect of suppressing the passage of pressure and liquid from a gap in the side of the retraction type movable valve 31. Further, a second heat generating member 19 (in the present embodiment, a heat generating resistance member of a shape of 40 $\mu$m×100 $\mu$m) is disposed at a location on the element substrate 1 which is opposed to the retraction type movable valve 31, and in that portion in the second liquid flow path 16 which is opposed to the heat generating member 19, there is formed a second bubble creating area 11 for heating the liquid in the flow path by the heat generating member 19, and creating a bubble by the film boiling phenomenon so that the pressure by the disappearance of the bubble in the bubble creating area 11 may act on the retraction type movable valve 31. The first liquid flow path 10 and the second liquid flow path 16 are substantially separated from each other by the retraction type movable valve 31 and the separating wall 30, whereby the interference of the pressure of each partner is suppressed, but the two liquid flow paths may partly communicate with each other and my use the same liquid in common.

The operation of the liquid discharging head constructed as described above will hereinafter be described.

FIGS. 2A to 2E are views for illustrating the operation of the liquid discharging head shown in FIGS. 1A to 1C.

When a driving pulse is not applied to the heat generating members 2 and 19, the liquid is not heated in the bubble creating areas 15 and 11 and no bubble is created. Therefore, the liquid is not discharged from the discharge port 18 and the retraction type movable valve 31 is not displaced (FIG. 2A).

Figure 2A:
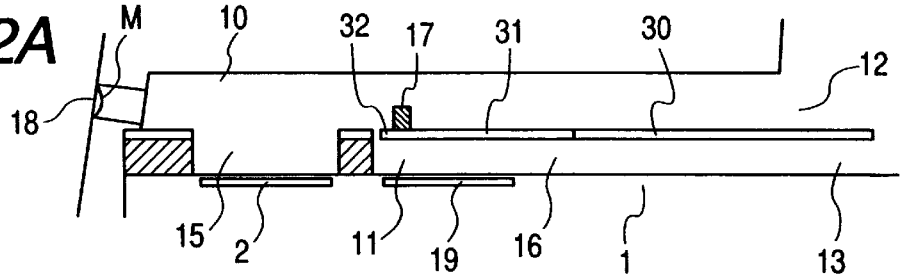
FIGS. 2A, 2B, 2C, 2D and 2E are views for illustrating the operation of the liquid discharging head shown in FIGS. 1A to 1C.
Figure 2B:
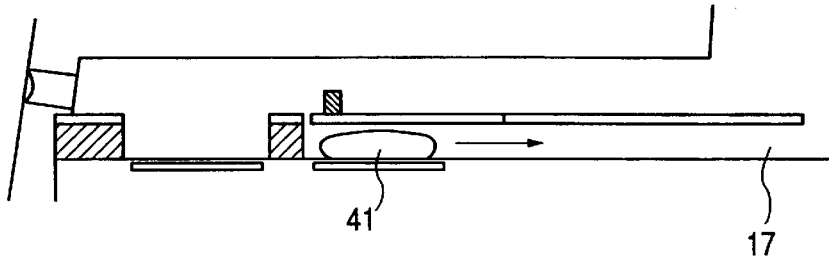

When a driving pulse is applied to the heat generating member 19 in the state shown in FIG. 2A, the liquid is heated in the bubble creating area 11 on the heat generating member 19 and a bubble 41 is created. At this time, the pressure by the creation of the bubble 41 acts on the retraction type movable valve 31, but the retraction type movable valve 31 has the displacement of its free end 32 toward the first liquid flow path 10 side limited by the displacement stopper 17 and therefore is hardly displaced (FIG. 2B). Also, design is made such that the movement of the liquid by the creation of the bubble 41 goes toward a second common liquid chamber 13 communicating with the second liquid flow path 16 and therefore, there is little or no influence of the creation of the bubble 41 upon the first liquid flow path 10.

Figure 2C:
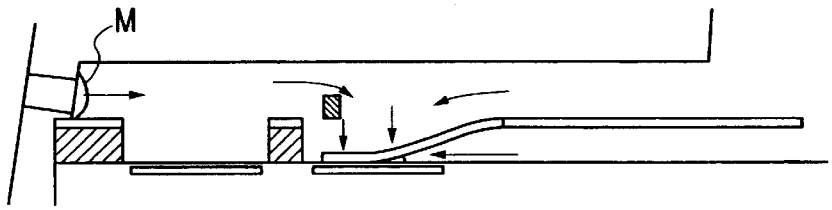
Figure 2D:
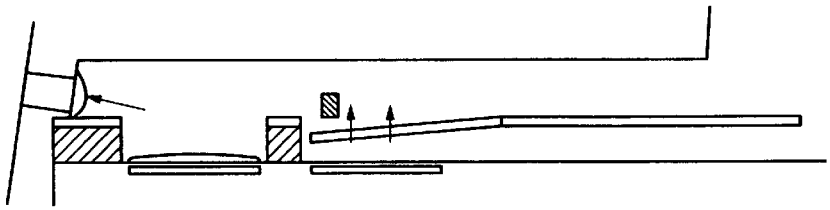
Figure 2E:
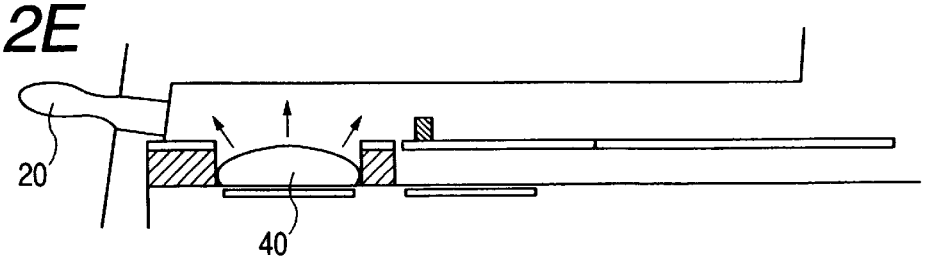

Thereafter, when the bubble 41 contracts, a pull-in force to the bubble creating area 11 is produced with the contraction of the bubble 41, but this pull-in force greatly acts on the displacement of the retraction type movable valve 31 toward the second liquid flow path 16 side rather than on the movement of the liquid from the second common liquid chamber 13 side. When the retraction type movable valve 31 is displaced toward the second liquid flow path 16 side, the liquid in the first liquid flow path 10 is pulled into the second liquid flow path 16 side. Thereupon, a meniscus M formed in the discharge port 18 is pulled into the first liquid flow path 10 side and retreats greatly (FIG. 2C). Thus, the meniscus M is pulled in by the displacement of the retraction type movable valve 31.

Thereafter, when a driving pulse is applied to the heat generating member 2, part of the liquid in the first liquid flow path is discharged as a liquid droplet 20 from the discharge port 18 (FIGS. 2D and 2E), but at that time, in the state shown in FIG. 2C, the meniscus M is pulled in from the discharge port 18 and therefore, as compared with a case where the meniscus M is not pulled in from the discharge port 18, the distance between the bubble 40 created in the bubble creating area 15 and the meniscus M becomes shorter. That is, the amount of liquid discharged from the discharge port 18 becomes smaller. By the utilization of this mechanism, the timing of the application of the driving pulse to the heat generating members 2 and 19 is controlled, whereby the amount of liquid discharged from the discharge port can be adjusted.

Figures 3A, 3B, 3C, 3D, 3E:
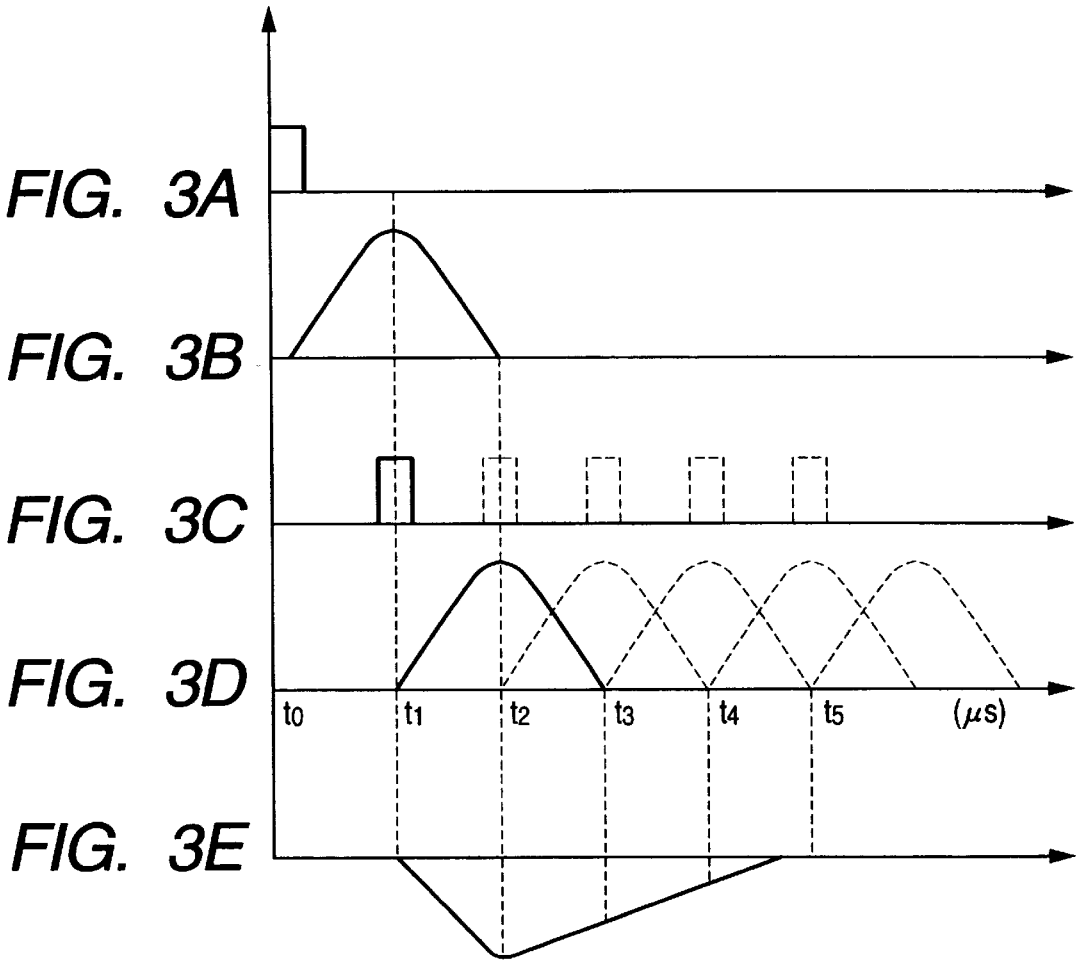
FIGS. 3A, 3B, 3C, 3D and 3E show the timing in the steps shown in FIGS. 2A to 2E, FIG. 3A showing the timing of the application of a driving pulse to a heat generating member, FIG. 3B showing a change in the volume of a bubble created in a bubble creating area, FIG. 3C showing the timing of the application of a driving pulse to the heat generating member, FIG. 3D showing a change in the volume of the bubble created in the bubble creating area, and FIG. 3E showing a change in the amount of retreat of a meniscus M.

FIGS. 3A to 3E show the timing in the steps shown in FIGS. 2A to 2E, FIG. 3A showing the timing of the application of the driving pulse to the heat generating member 19, FIG. 3B showing a change in the volume of a bubble 41 created in the bubble creating area 11, FIG. 3C showing the timing of the application of the driving pulse to the heat generating member 2, FIG. 3D showing a change in the volume of a bubble 40 created in the bubble creating area 15, and FIG. 3E showing a change in the amount of retreat of the meniscus M. In these figures, the cases where the timing of the driving pulse to the heat generating member 2 has been applied to $t_1$ to $t_5$ are represented by solid lines and broken lines at a time.

In the present embodiment, when a driving pulse is applied to the heat generating member 19 at a time t0, a bubble 41 is created in the bubble creating area 11, and at the time t1, the volume of the bubble 41 becomes greatest, but in this state, the retraction type movable valve 31 is not displaced and therefore, the retreat of the meniscus M is not seen.

Thereafter, when the bubble 41 contracts, the meniscus M retreats therewith, but after the bubble 41 disappears completely at the time t2 and the amount of retreat of the meniscus M becomes greatest, the amount of retreat of the meniscus M gradually decreases.

When as shown in FIGS. 3A to 3E, a driving pulse is applied to the heat generating member 2 at the time t2, a bubble 40 assuming the greatest volume at the time t3 is created in the bubble creating area 15, whereby part of the liquid in the first liquid flow path 10 is discharged from the discharge port 18.

Here, the amount of liquid present between the meniscus M and the bubble 40 differs in conformity with the amount of retreat of the meniscus M and therefore, the amount of liquid discharged from the discharge port differs depending on the amount of retreat of the meniscus M.

Figure 4:
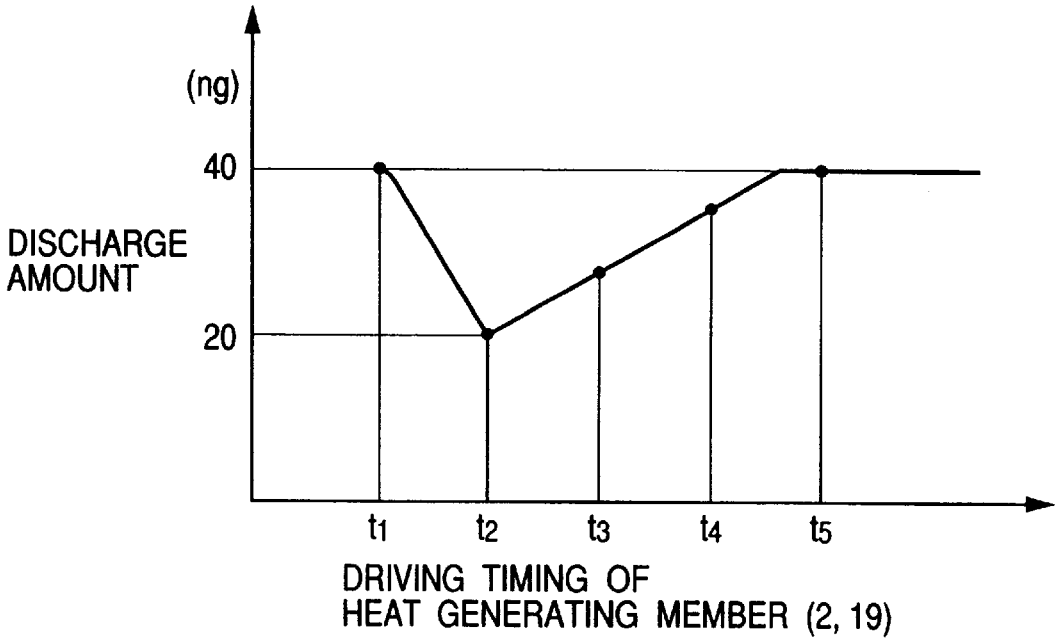
FIG. 4 shows a change in the amount of liquid discharge relative to the driving timing to the heat generating member shown in FIGS. 3A to 3E.

FIG. 4 shows a change in the amount of liquid discharge relative to the driving timing to the heat generating members 2 and 19 shown in FIGS. 3A to 3E.

As shown in FIG. 4, the greater is the amount of retreat of the meniscus M, the smaller is the amount of liquid discharged from the discharge port 18. By the utilization of this mechanism, the timing of the application of the driving pulse to the heat generating members 2 and 19 is controlled, whereby the amount of liquid discharged from the discharge port 18 can be adjusted.

In the present embodiment, design may be made such that the positions of the heat generating member 2 and the retraction type movable valve 31 as a negative pressure generating portion are replaced with each other to thereby enhance the effect of negative pressure to the meniscus, and the modulation area of the discharge amount may be made large.

(Second Embodiment)

Figure 5A:
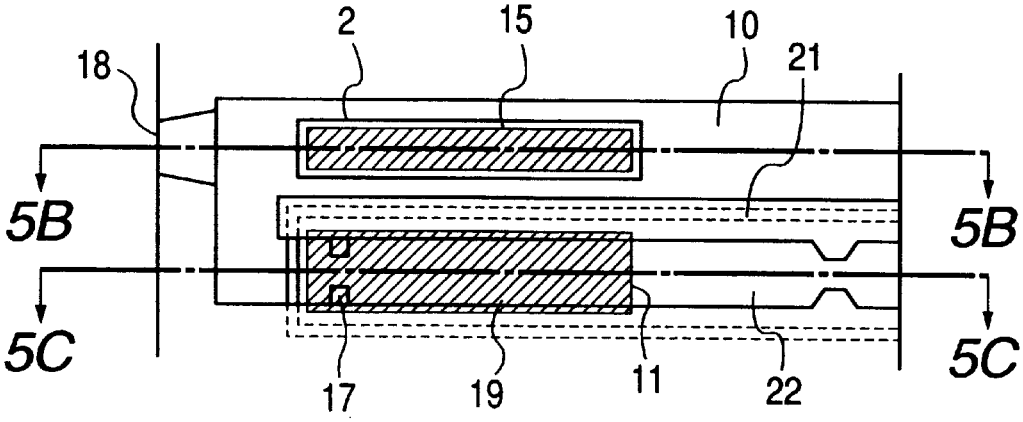
FIGS. 5A, 5B and 5C show a second embodiment of the liquid discharging head of the present invention, FIG. 5A being a top seen-through view, FIG. 5B being a cross-sectional view taken along the line 5B—5B of FIG. 5A, and FIG. 5C being a cross-sectional view taken along the line 5C—5C of FIG. 5A.
Figure 5B:
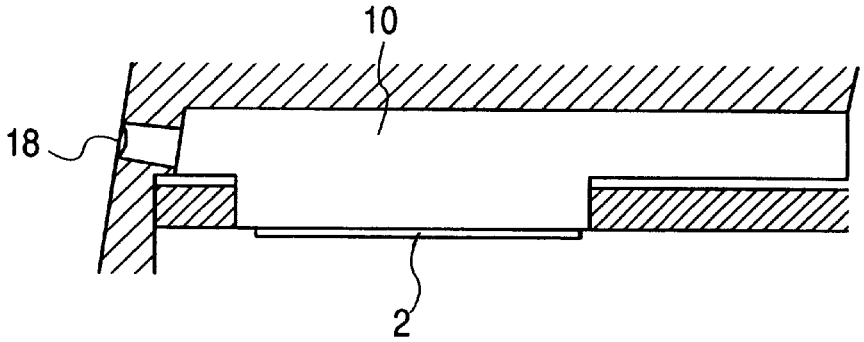
Figure 5C:
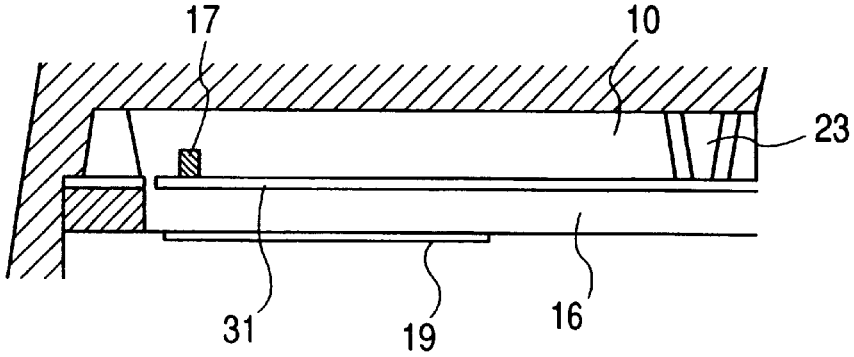

FIGS. 5A to 5C show a second embodiment of the liquid discharging head of the present invention, FIG. 5A being a top seen-through view, FIG. 5B being a cross-sectional view taken along the line 5B—5B of FIG. 5A, and FIG. 5C being a cross-sectional view taken along the line 5C—5C of FIG. 5A.

This embodiment, as shown in FIGS. 5A to 5C, differs from the first embodiment in which the heat generating member 2 and the retraction type movable valve 31 are vertically arranged relative to the direction of flow of the liquid in the liquid flow path, only in that the heat generating member 2 and the retraction type movable member 31 are laterally arranged relative to the direction of flow of the liquid in the liquid flow path with a flow path wall 21 interposed therebetween and near the discharge port 18, an area in which the heat generating member 2 is provided and an area in which the retraction type movable valve 31 is provided communicate with each other.

Particularly, the present embodiment is designed such that the retraction type movable valve 31 acts between the bubble creating area 15 and the discharge port 18, whereby the capability of controlling the liquid flow in the direction of the discharge port 18 by the bubble created in the bubble creating area 15 is enhanced.

Further, in the present embodiment, the heat generating member 2 is of a size of 40 $\mu$m×100 $\mu$m and the heat generating member 19 is of a size of 80×100 $\mu$m, whereby the above-mentioned controlling capability is further enhanced. Also, the driving timing of each heat generating member differs from that shown in the first embodiment, and provides a discrete discharge state.

Also, negative pressure produced in a third liquid flow path 22 enhances the action into the first liquid flow path and therefore, a fluid resistance element 23 is provided at a side near the second common liquid chamber of the third liquid flow path 22, whereby the effect can be enhanced.

The operation of the liquid discharging head constructed as described above will hereinafter be described.

FIGS. 6A to 6H are views for illustrating the operation of the liquid discharging head shown in FIGS. 5A to 5C, FIGS. 6A to 6D being top seen-through views, and FIGS. 6E to 6H being cross-sectional views taken along the lines 6E—6E to 6H—6H, respectively, of FIGS. 6A to 6D.

When a driving pulse is not applied to the heat generating members 2 and 19, the liquid is not heated in the bubble creating areas 15 and 11 and no bubble is created. Therefore, the liquid is not discharged from the discharge port 18 and the retraction type movable valve 31 is not displaced (FIG. 6A).

Figure 6A:
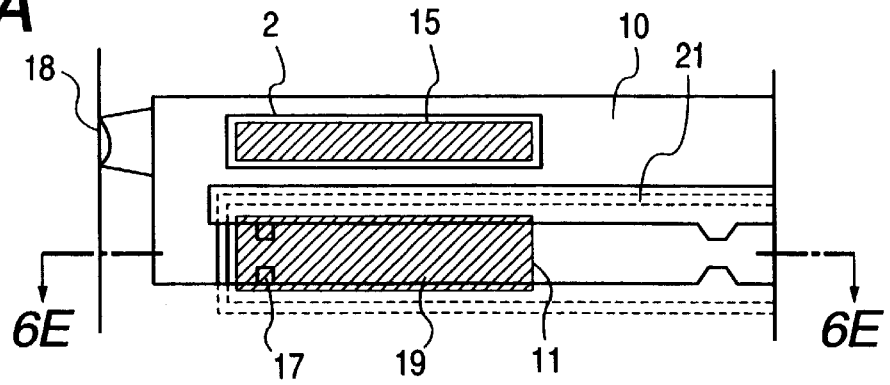
FIGS. 6A, 6B, 6C, 6D, 6E, 6F, 6G and 6H are views for illustrating the operation of the liquid discharging head shown in FIGS. 5A to 5C, FIGS. 6A to 6D being top seen-through views, and FIGS. 6E to 6H being cross-sectional views taken along the lines 6E—6E to 6H—6H, respectively, of FIGS. 6A to 6D.
Figure 6B:
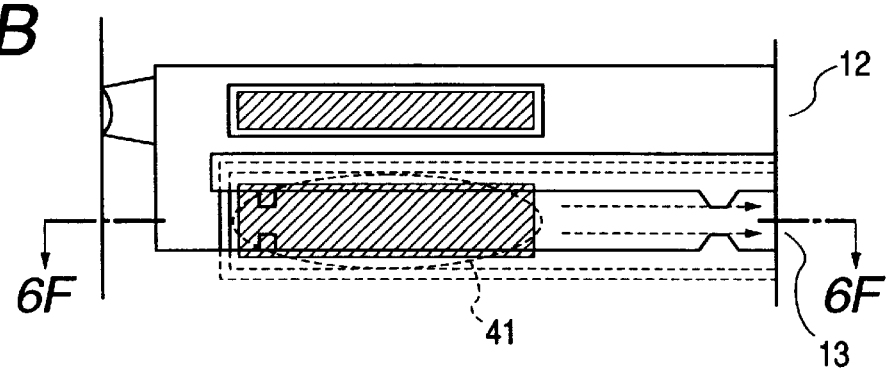

When in the state shown in FIG. 6A, a driving pulse is applied to the heat generating member 19, the liquid is heated in the bubble creating area 11 on the heat generating member 19 and a bubble 41 is created. At this time, the pressure by the creation of the bubble 41 acts on the retraction type movable valve 31, but the retraction type movable valve 31 is hardly displaced because its displacement to the side opposite to the bubble creating area 11 is limited by a displacement stopper 17 (FIG. 6B). Also, design is made such that the movement of the liquid by the creation of the bubble 41 goes toward a second common liquid chamber 13 communicating with a second liquid flow path 16 and therefore, there is little or no influence of the creation of the bubble 41 upon the first liquid flow path 10.

Figure 6C:
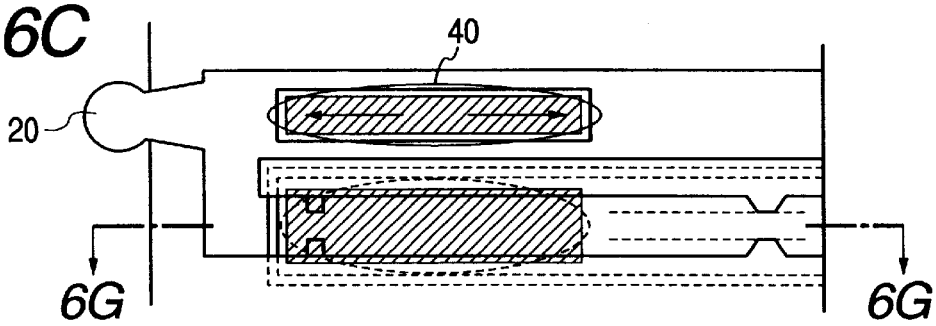
Figure 6D:
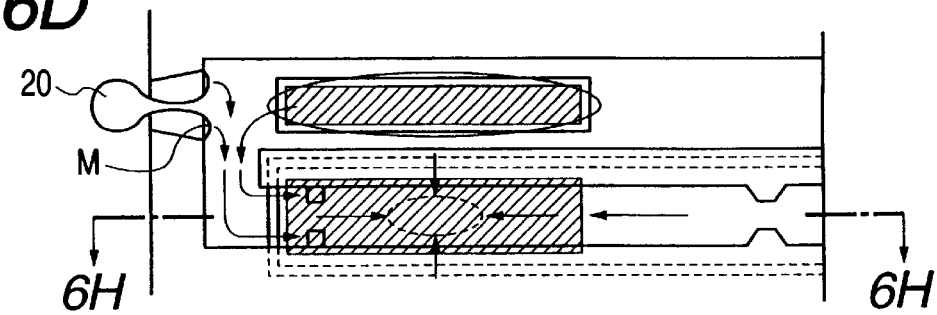
Figure 6E:
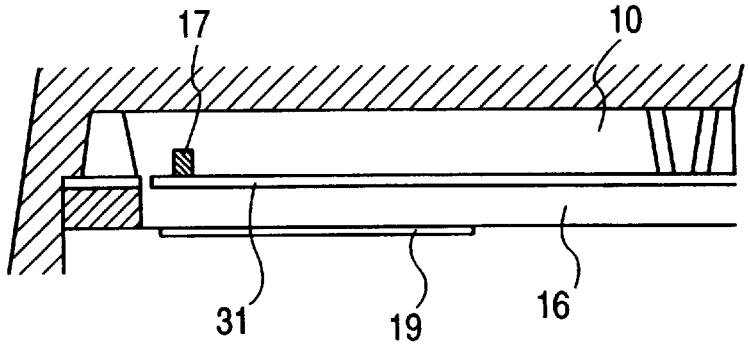
Figure 6F:
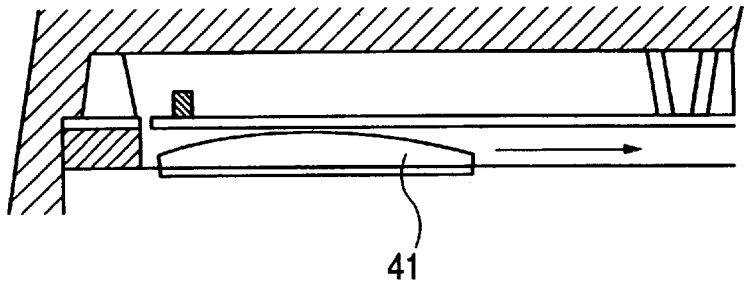
Figure 6G:
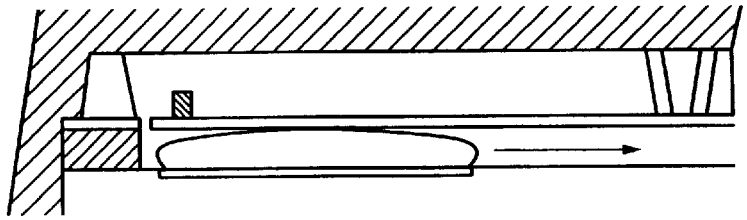
Figure 6H:
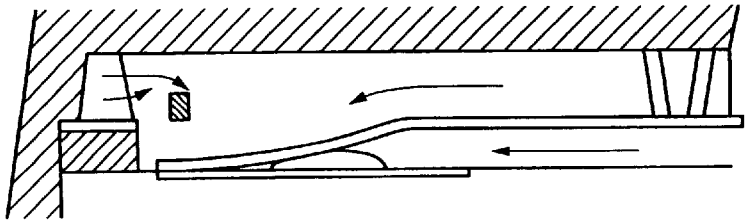

When in the state shown in FIG. 6B, a driving pulse is applied to the heat generating member 2, the liquid is heated in the bubble creating area 15 on the heat generating member 2 and an bubble 40 is created, and by the pressure by the creation of the bubble 40, part of the liquid in the first liquid flow path 10 begins to be discharged as a liquid droplet 20 from the discharge port 18 (FIG. 6C).

Thereafter, when the bubble 41 contracts and the bubble 40 grows larger, a pull-in force to the bubble creating area 11 is produced with the contraction of the bubble 41, but this pull-in force greatly acts on the displacement of the retraction type movable valve 31 toward the bubble creating area 11 side rather than on the movement of the liquid from the second common liquid chamber 13 side. When the retraction type movable valve 31 is displaced toward the bubble creating area 11 side, the liquid in the first liquid flow path 10 is pulled in toward the second liquid flow path 16 side. Thereupon, a meniscus M formed in the discharge port 18 is pulled into the liquid flow path and retreats greatly. At the same time, the bubble 40 grows larger and part of the liquid in the first liquid flow path 10 is discharged as a liquid droplet 20 from the discharge port 18.

Thus, the liquid droplet 20 originally assuming a flying state by the contraction of the bubble 40 is discharged from the discharge port 18 in its state before that, whereby it becomes possible to decrease the discharge amount, and the discharge speed of the liquid droplet 20 becomes the speed during the growth of the bubble 40. Accordingly, by such a mechanism, the discharge speed is made constant and the discharge amount can be varied.

Figures 7A, 7B, 7C, 7D, 7E:
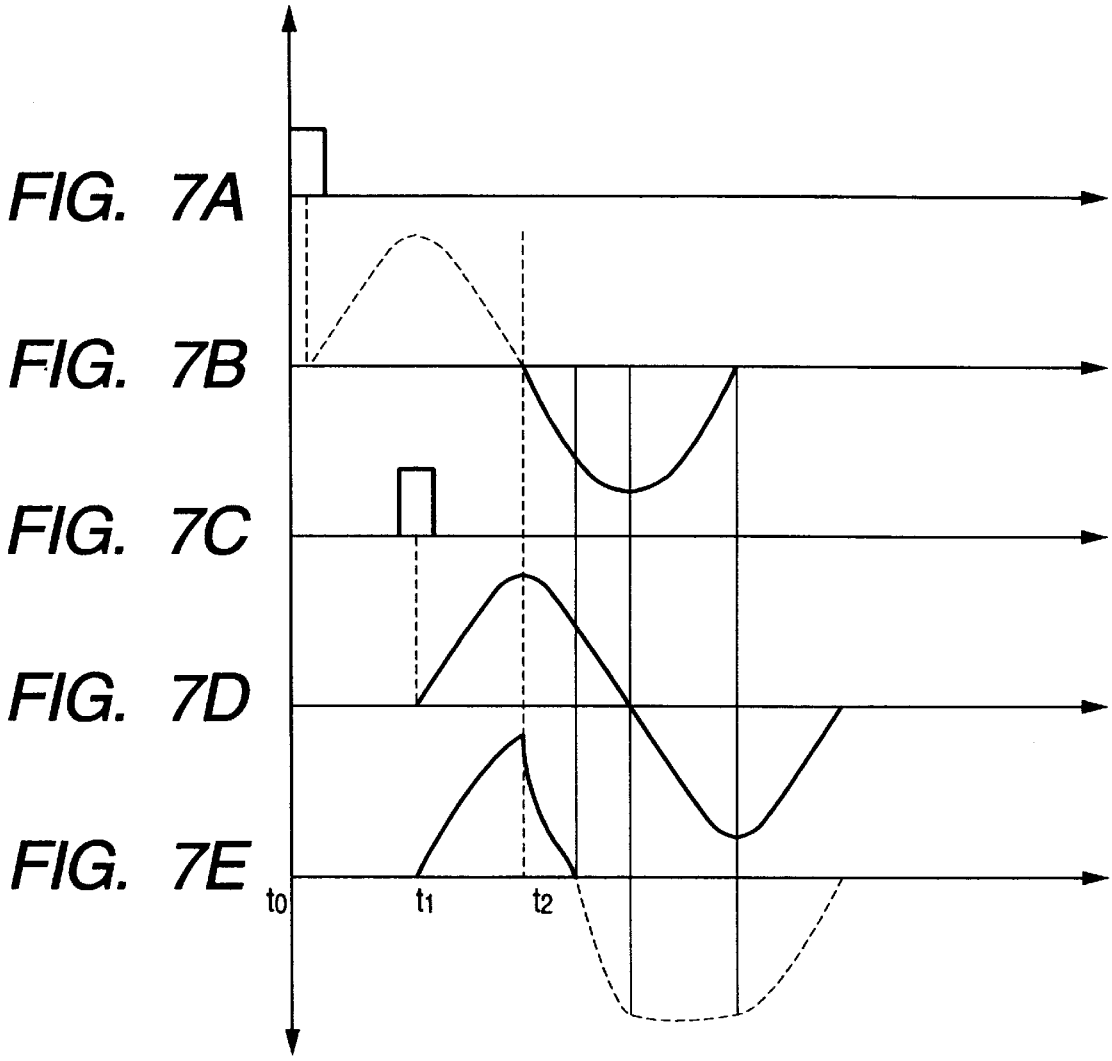
FIGS. 7A, 7B, 7C, 7D and 7E show the timing in the steps shown in FIGS. 6A to 6H, FIG. 7A showing the timing of the application of a driving pulse to a heat generating member, FIG. 7B showing a change in the volume of a bubble created in a bubble creating area, FIG. 7C showing the timing of the application of a driving pulse to the heat generating member, FIG. 7D showing a change in the volume of the bubble created in the bubble creating area, and FIG. 7E showing a change in the discharge amount of a liquid droplet relative to the time delays of respective pulses shown in FIGS. 7A and 7C.
Figure 8A:
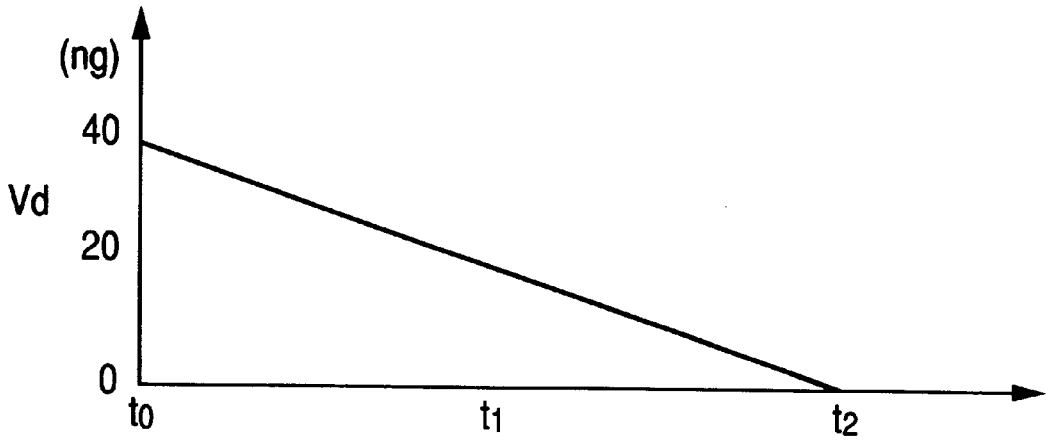
FIGS. 8A and 8B show the discharge amount and discharge speed of liquid when in the liquid discharging head shown in FIGS. 5A to 5C, the timing of the application of the driving pulse to the heat generating member is a time t0, FIG. 8A being a graph showing the relation between the timing of the application of the driving pulse to the heat generating member and the discharge amount, and FIG. 8B being a graph showing the relations among the timing of the application of the driving pulse to the heat generating member, the discharge amount of liquid with a discharge port as the standard and the meniscus amount.
Figure 8B:
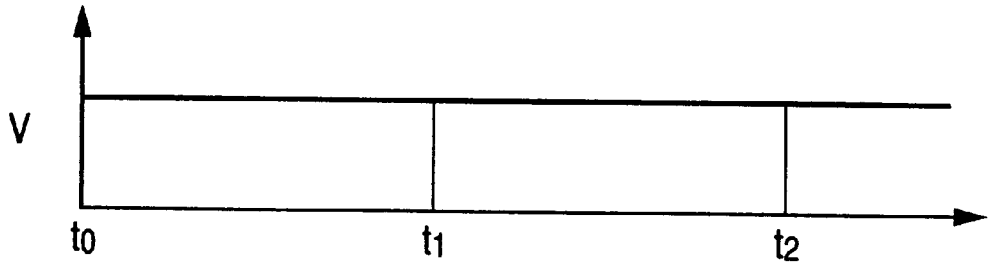

FIGS. 7A to 7E show the timing at the steps shown in FIGS. 6A to 6H, FIG. 7A showing the timing of the application of a driving pulse to the heat generating member 19, FIG. 7B showing a change in the volume of the bubble 41 created in the bubble creating area 11, FIG. 7C showing the timing of the application of the driving pulse to the heat generating member 2, and FIG. 7D showing a change in the volume of the bubble 40 created in the bubble creating area 15. FIGS. 8A and 8B show the discharge amount and discharge speed of the liquid when in the liquid discharging head shown in FIGS. 5A to 5C, the timing of the application of the driving pulse to the heat generating member 19 is t0, FIG. 8A being a graph showing the relation between the timing of the application of the driving pulse to the heat generating member 2 and the discharge amount, and FIG. 8B being a graph showing the relations among the timing of the application of the driving pulse to the heat generating member 2, the discharge amount and the meniscus amount of the liquid with the discharge port as the standard.

As shown in FIGS. 7A to 7E and 8A and 8B, by changing the timing of the application of the driving pulse to the heat generating member 19 and the timing of the application of the driving pulse to the heat generating member 2, the discharge amount can be changed without the discharge speed of the liquid discharged from the discharge port 18 being changed.

Thus, the modulation of the discharge amount of which the controllability is very high becomes possible simply by changing the delay of the rectangular pulse and therefore, by this discharging method, it is also possible to form a harmony image by the modulation of the area of dots.

(Third Embodiment)

In the embodiments described and shown above, by adjusting the timing of the application of the driving pulse to the heat generating member, the vibration of the meniscus occurring after the discharge of the liquid can be suppressed.

Figures 9A, 9B, 9C, 9D, 9E:
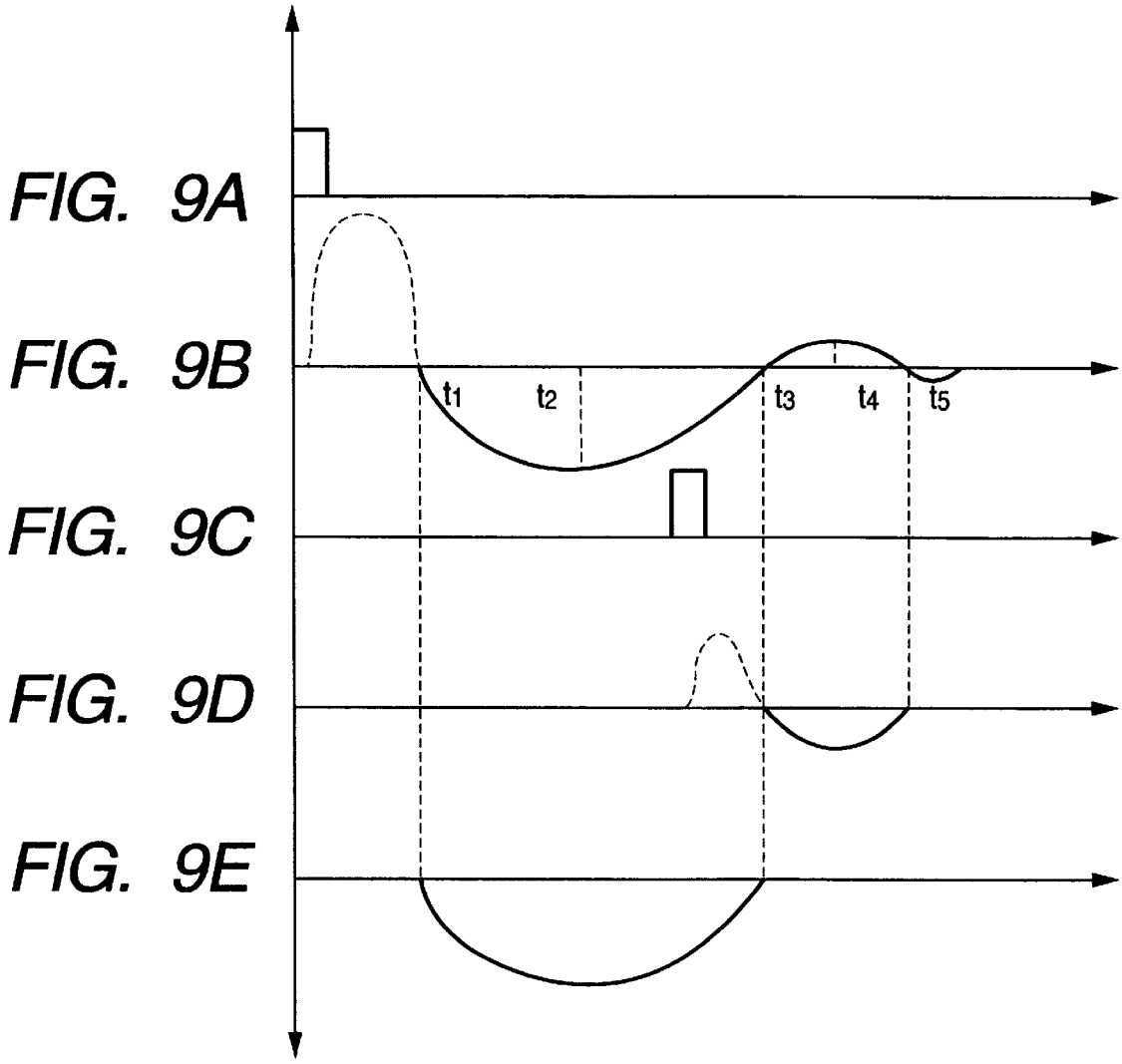
FIGS. 9A, 9B, 9C, 9D and 9E show another example of the operation characteristic of the liquid discharging head shown in FIGS. 1A to 1C, FIG. 9A showing the timing of the application of a driving pulse to the heat generating member, FIG. 9B showing a change in the meniscus M by only a bubble created in the bubble creating area, FIG. 9C showing the timing of the application of a driving pulse to the heat generating member, FIG. 9D showing a change in the meniscus M by only a bubble created in the bubble creating area, and FIG. 9E showing the state of the meniscus when the operations in FIGS. 9B and 9D are caused at a time.

FIGS. 9A to 9E show another example of the operation characteristic of the liquid discharging head shown in FIGS. 1A to 1C, FIG. 9A showing the timing of the application of the driving pulse to the heat generating member 2, FIG. 9B showing the change in the meniscus M by only the bubble 40 created in the bubble creating area 15, FIG. 9C showing the timing of the application of the driving pulse to the heat generating member 19, FIG. 9D showing the change in the meniscus M by only the bubble 41 created in the bubble creating area 11, and FIG. 9E showing the state of the meniscus when the operations in FIGS. 9B and 9D are caused at a time.

Usually, the meniscus M by the discharge by the creation of the bubble 40, as shown in FIG. 9B, begins to retreat at a time t1 by the contraction of the bubble with the flying of a liquid droplet, and the amount of retreat becomes greatest at a time t2, whereafter the meniscus begins to be returned toward the discharge port 18 by the capillary force of the first liquid flow path 10 and the discharge port 18.

At a time t3, the meniscus M arrives at the discharge port 18, whereafter by the inertia force of the liquid flow in the liquid flow path, the meniscus M overshoots outwardly from the discharge port 18, and thereafter (a time t4), at a time t5, it settles down in the discharge port 18.

This overshooting adversely affects the stability of the next discharge.

Therefore, the retraction type movable valve 31 is operated so as to be timed with this overshooting of the meniscus M, whereby at a time tM, a pulse is applied to the heat generating member 19 as shown in FIG. 9C, whereupon the action onto the meniscus M becomes such as shown in FIG. 9D.

By combining the operations of the meniscus M shown in FIGS. 9B and 9D, there can be realized a stable discharge state free of the overshooting of the meniscus as shown in FIG. 9E.

(Other Embodiments)

Figure 10:
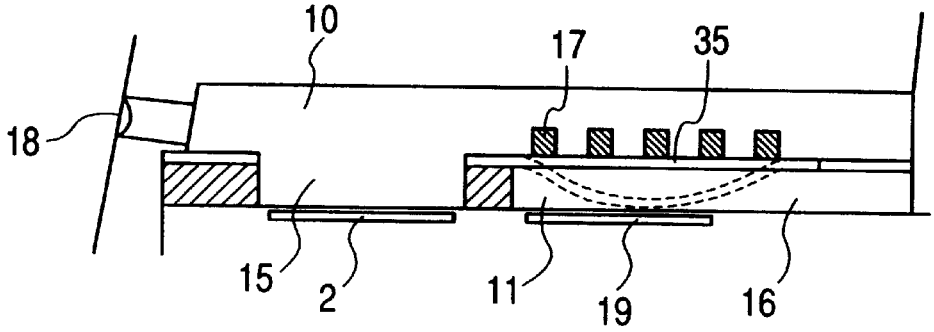
FIG. 10 shows another embodiment of the liquid discharging head of the present invention.
Figure 11:
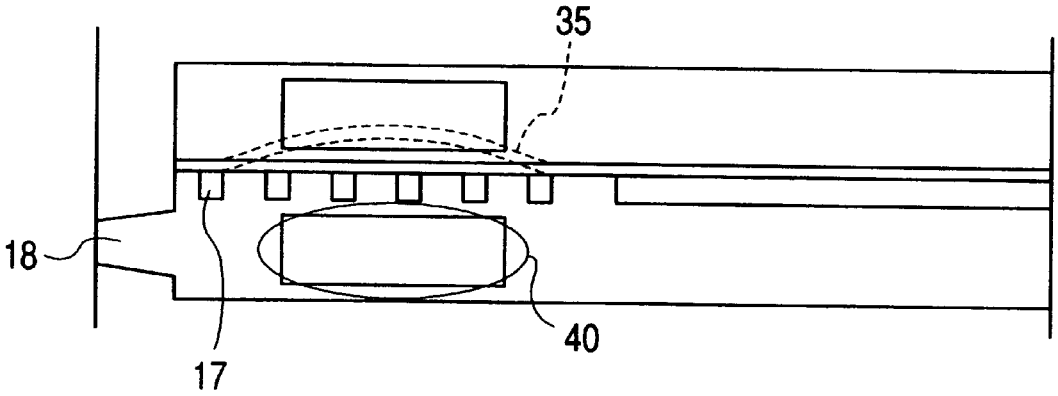
FIG. 11 shows another embodiment of the liquid discharging head of the present invention.
Figure 12:
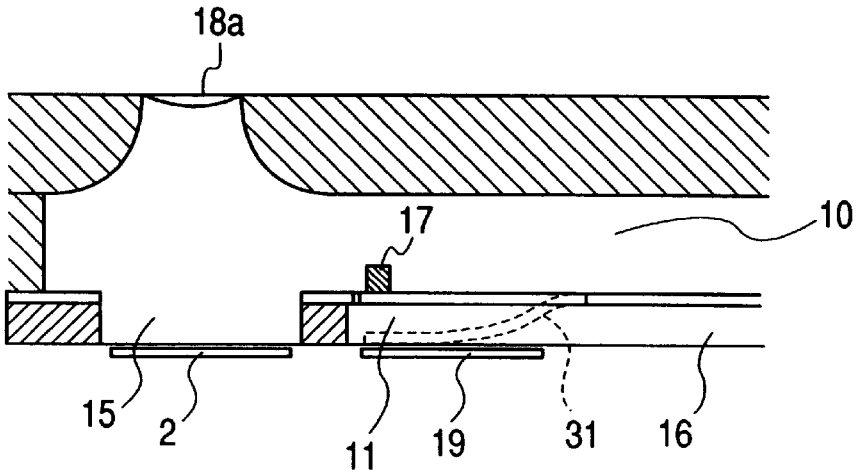
FIG. 12 shows another embodiment of the liquid discharging head of the present invention.

FIGS. 10 to 12 show other embodiments of the liquid discharging head of the present invention.

In the embodiment shown in FIG. 10, retraction type movable separating film 35 is provided instead of the retraction type movable valve, and the first liquid flow path and the second liquid flow path can be completely separated from each other and therefore, there is obtained a characteristic in which the refraction effect is high.

In the embodiment shown in FIG. 11, retraction type movable separating film 35 is provided on a side of the first liquid flow path, and the area of the movable separating film 35 which directly acts on the bubble 40 is large and therefore, the responsiveness of meniscus control is high.

The embodiment shown in FIG. 12 is one in which the first embodiment is applied to a head structure of a type in which a discharge port is provided at a location opposed to the heat generating member 2, and the disposition of the discharge port can be two-dimensionally applied.

In the foregoing embodiments, description has been made of the liquid discharge control in the liquid discharging head, but the liquid discharging head of the present invention can also detect the presence/absence or state of the liquid in the liquid flow path.

Figure 13:
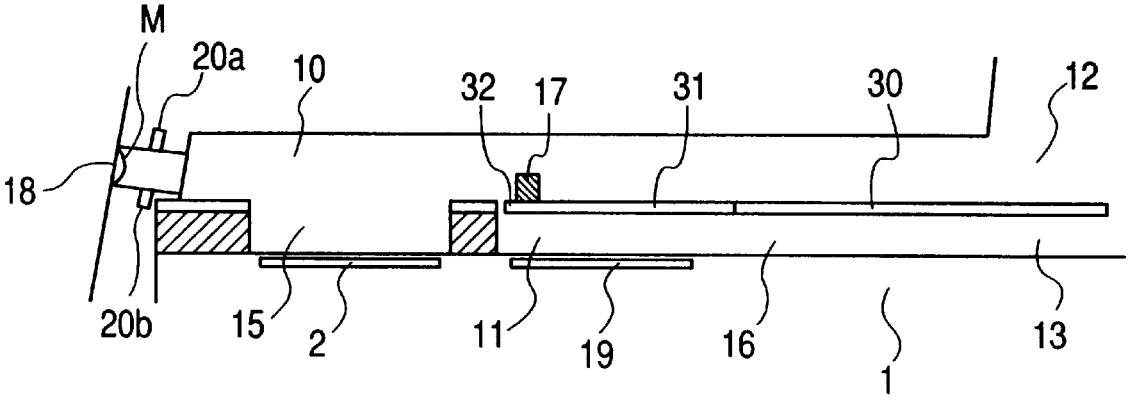
FIG. 13 shows an example for detecting the presence or state of the liquid in a liquid flow path by the use of the liquid discharging head of the present invention.

FIG. 13 shows an embodiment which detects the presence/absence or state of the liquid in the liquid flow path by the use of the liquid discharging head of the present invention.

As shown in FIG. 13, in the present embodiment, sensors 20*a* and 20*b* which are detecting means for detecting the presence/absence of the liquid are provided near the discharge port 18 in opposed relationship with each other.

As a method of detecting the presence/absence of the liquid, there are conceivable an absolute detecting method of presetting a certain reference value, and comparing a detected level with the reference value to thereby detect the presence of the liquid, and a relative detecting method of comparing two detection levels differing in conditions from each other to thereby detect the presence of the liquid.

The former absolute detecting method, however, suffers from the problem that the reference value with which the detected level is to be compared must be predetermined or the reference value changes due to some or other cause.

So, if the present invention is used for liquid detection, the presence of the liquid can be detected by the latter relative detecting method.

First, in a state in which a driving pulse is not applied to the heat generating member 19, the presence of the liquid is detected by the sensors 20*a* and 20*b*.

Next, a driving pulse is applied to the heat generating member 19 to thereby create a bubble 41 in the bubble creating area 11, whereafter in a state in which the created bubble 41 has disappeared, the presence of the liquid is detected by the sensors 20*a* and 20*b*.

By comparing the above-described two detection results with each other, the state such as the presence/absence of the liquid can be detected. When the two detection results differ from each other, the liquid near the discharge port is considered to have been moved by the displacement of the retraction type movable valve 31, and it is judged that the liquid is normally present in the liquid flow path.

On the other hand, when the liquid is not present in the liquid flow path or the liquid is secured to the interior of the liquid flow path, the detected levels in said two states become equal to each other.

Thus, when the detected levels in said two states are equal to each other, it can be judged that the liquid is not present in the liquid flow path or the liquid is secured to the interior of the liquid flow path, and when the detected levels differ from each other, it can be judged that the liquid is normally present in the liquid flow path.

<Head Structure of Two-Flow-Path Construction>

Description will hereinafter be made of an example of the structure of a liquid discharging head which can well separate and introduce different liquids into first and second common liquid chambers and can achieve the curtailment of the number of parts and enables a reduction in cost to be achieved.

Figure 14:
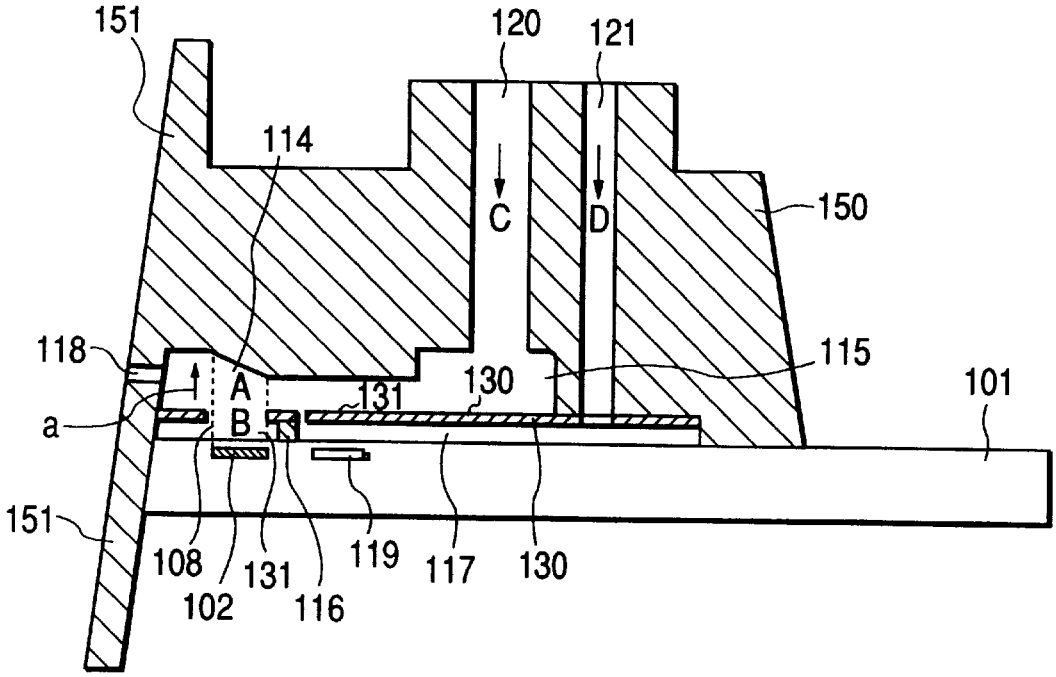
FIG. 14 is a typical view showing the structure of the liquid discharging head of the present invention.

FIG. 14 is a typical view showing the structure of the liquid discharging head of the present invention, and in FIG. 14, the same constituents as those in the previous embodiments are given the same reference numerals and need not be described in detail.

In the present embodiment, a grooved member 150 is generally comprised of an orifice plate 151 having a discharge port 118, a plurality of grooves constituting a plurality of first liquid flow paths 114, and a recess constituting a first common liquid chamber 115 communicating with the plurality of liquid flow paths 114 in common for supplying liquid to each first liquid flow path 103.

A separating wall 130 can be joined to the lower portion of this grooved member 150 to thereby form a plurality of first liquid flow paths 114. Such a grooved member 150 has a first liquid supply path 120 leading from the upper portion thereof into the first common liquid chamber 120. Also, the grooved member 150 has a second liquid supply path 121 leading from the upper portion thereof through the separating wall 130 into a second common liquid chamber 117.

A first liquid, as indicated by arrow C in FIG. 14, may be supplied to the first common liquid chamber 115 via the first liquid supply path 120, and then to the first liquid flow path 114, and a second liquid, as indicated by arrow D in FIG. 14, may be supplied to the second common liquid chamber 117 via the second liquid supply path 121, and then to the second liquid flow path 116.

In the present embodiment, the second liquid supply path 121 is disposed in parallelism to the first liquid supply path 120, whereas this is not restrictive, but the second liquid supply path 121 may be disposed in any manner if it is formed through the separating wall 130 disposed outside the first common liquid chamber 115 so as to communicate with the second common liquid chamber 117.

Also, the thickness (diameter) of the second liquid supply path 121 is determined with the amount of supply of the second liquid taken into account. The shape of the second liquid supply path 121 need not be round, but may be rectangular or the like.

Also, the second common liquid chamber 117 can be formed by partitioning the grooved member 150 by the separating wall 130. As a method of forming it, as shown in the exploded perspective view of the present embodiment shown in FIG. 15, a common liquid chamber frame and a second liquid path wall may be formed on an element base plate by dry film, and a coupled member comprising the grooved member 150 having a separating wall fixed thereto and the separating wall 130 and the element base plate 101 may be cemented together to thereby form the second common liquid chamber 117 and the second liquid flow path 116.

In the present embodiment, on a support member 170 formed of a metal such as aluminum, there is disposed an element substrate 101 on which are provided a plurality of electrothermal conversion elements as heat generating members generating heat for creating a bubble by film boiling for bubble creating liquid, as previously described.

On this element base plate 101, there are disposed a plurality of grooves constituting the liquid flow path 116 formed by a second liquid path wall, a recess constituting the second common liquid chamber (common bubble creating liquid chamber) 117 communicating with a plurality of second liquid flow paths for supplying the second liquid to the respective second liquid paths, and the separating wall 130 provided with the aforementioned movable wall 131.

The reference numeral 150 designates a grooved member. This grooved member 150 has a groove joined to the separating wall 130 to thereby constitute a first liquid flow path 114, a recess for constituting a first common liquid chamber (common discharge liquid chamber) 115 communicating with the first liquid flow path for supplying the first liquid to the first liquid flow path, a first supply path 120 for supplying the first liquid to the first common liquid chamber, and a second supply path 121 for supplying the second liquid to the second common liquid chamber 117. The second supply path 121 communicates with the second common liquid chamber 117 through the separating wall 130 disposed outside the first common liquid chamber 115.

The disposition relation among the element substrate 101, the separating wall 130 and the grooved top plate 150 is such that a movable member 131 is disposed correspondingly to the heat generating member of the element substrate 101 and the discharge liquid flow path 114 is disposed correspondingly to the movable member 131. Also, in the present embodiment, there has been shown an example in which the second supply path is disposed in a grooved member, but a plurality of second supply paths may be provided in conformity with the amount of supply.

By such optimization of the cross-sectional area of the flow path, it is also possible to make the part constituting the grooved member 150 or the like more compact.

As described above, according to the present embodiment, the second supply path for supplying the second liquid to the second liquid flow path and the first supply path for supplying the first liquid to the first liquid flow path comprise a grooved top plate as the same grooved member, whereby the number of parts can be curtailed and the shortening of the step and a reduction in cost become possible.

Also, the supply of the second liquid to the second common liquid chamber communicating with the second liquid flow path is designed to be effected by the second liquid flow path in a direction passing through the separating wall for separating the first liquid and the second liquid from each other and therefore, only one step of cementing the separating wall, the grooved member and the heat generating member forming base plate together is required, and the ease of making is improved and the accuracy of cementing is improved, and discharge can be effected well.

<First Liquid and Second Liquid>

When a head of the movable type separating film is used in a two-flow-path construction and the first liquid and the second liquid are discrete liquids, a liquid of the nature as previously described can be used as the second liquid, and as such liquid, mention may be specifically made of methanol, ethanol, n-propanol, isopropanol, n-hexane, n-heptane, n-octane, toluene, xylene, methylene dichloride, trichlene, freon TF, freon BF, ethylether, dioxane, cyclohexane, methyl acetate, ethyl acetate, acetone, methyl ethyl ketone, water or the like and a mixture of these.

<Manufacture of the Liquid Discharging Head>

Description will now be made of the steps of manufacturing the liquid discharging head of the present invention.

In the case of the liquid discharging head as shown in FIG. 14, a foundation 134 for providing the movable member 131 on the element base plate 101 was formed by patterning dry film or the like, and the movable member 131 was adhesively secured or fixed by welding to this foundation 134. Thereafter, a grooved member having a plurality of grooves constituting the liquid flow paths 110, a discharge port 118 and a recess constituting the common liquid chamber 113 was formed by being joined to the element base plate 101 in such a state that the grooves and the movable member correspond to one another.

Figure 15:
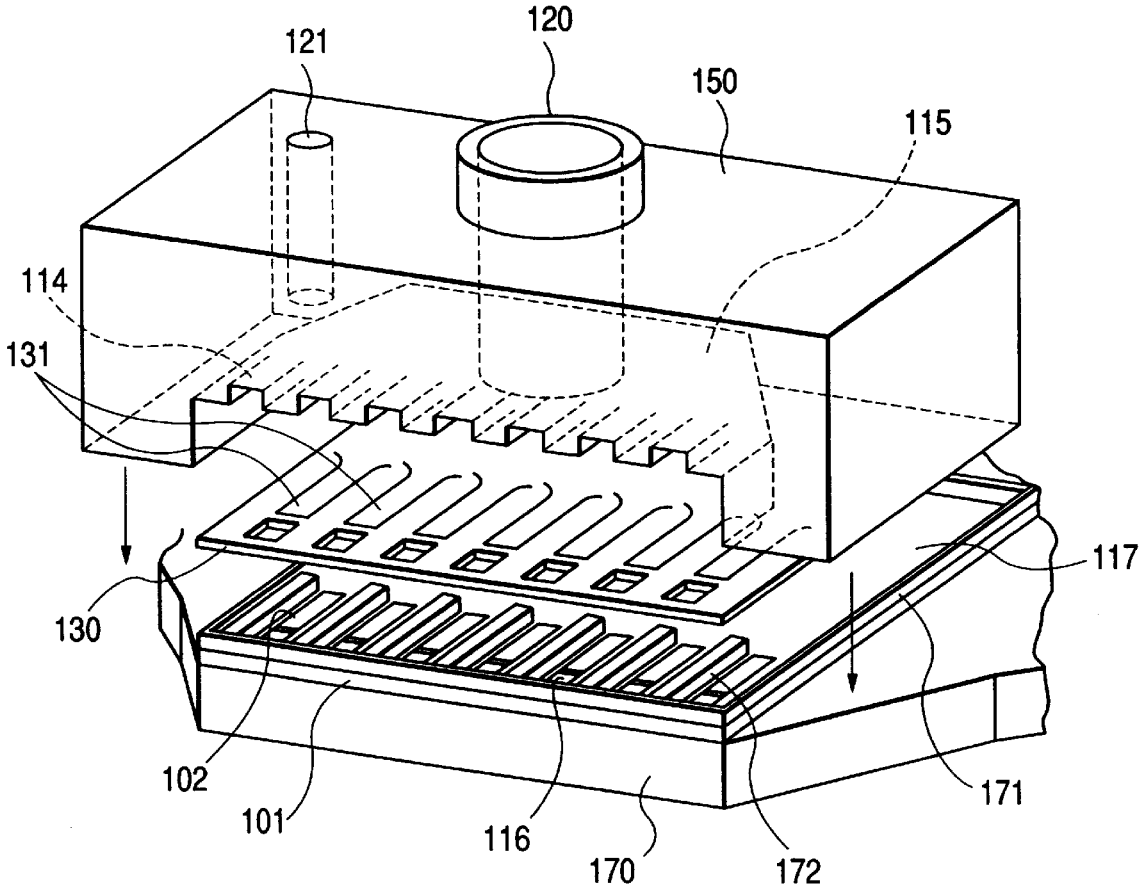
FIG. 15 is an exploded perspective view of the liquid discharging head of the present invention.

Description will now be made of the step of manufacturing a liquid discharging head of two-path construction as shown in FIG. 15.

Roughly, the wall of a second liquid flow path 116 is formed on the element substrate 101, a separating wall 130 is mounted thereon, and a grooved member 150 provided with a groove or the like constituting a first liquid flow path 114 is further mounted thereon. Or after the wall of a second liquid flow path 116 was formed, a grooved member 150 having a separating wall 130 mounted thereon was joined onto this wall, whereby the manufacture of a head was effected.

A method of making the second liquid flow path will further be described in detail.

FIGS. 16A to 16E are schematic cross-sectional views for illustrating a first embodiment of the method of manufacturing the liquid discharging head of the present invention.

Figure 16A:
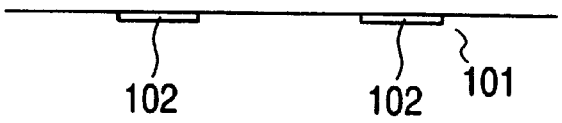
FIGS. 16A, 16B, 16C, 16D and 16E are step views for illustrating a method of manufacturing the liquid discharging head of the present invention.

In the present embodiment, as shown in FIG. 16A, an electrothermal conversion element having heat generating members 102 formed of hafnium boride, tantalum nitride or the like was formed on an element substrate (silicon wafer) 101 by the use of a manufacturing apparatus similar to that used in the semiconductor manufacturing process, whereafter the surface of the element substrate 101 was subjected to washing with a view to improve the intimate contacting property with photosensitive resin at the next step. Further, to improve the intimate contacting property, surface improvement by ultraviolet ray-ozone or the like is effected on the surface of the element base plate, whereafter the above-mentioned improved surface is spin-coated, for example, with a liquid composed of a silane coupling agent (produced by Nippon Unika: A189) diluted to 1% by weight by ethyl alcohol.

Figure 16B:
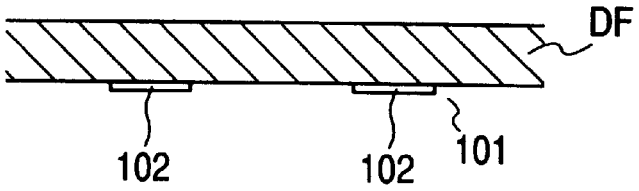

Next, the surface washing was done, and as shown in FIG. 16B, ultraviolet ray sensitive resin film (produced by Tokyo Ohka: Dry Film Ordil SY-318) DF was laminated on the base plate 101 improved in the intimate contacting property.

Figure 16C:
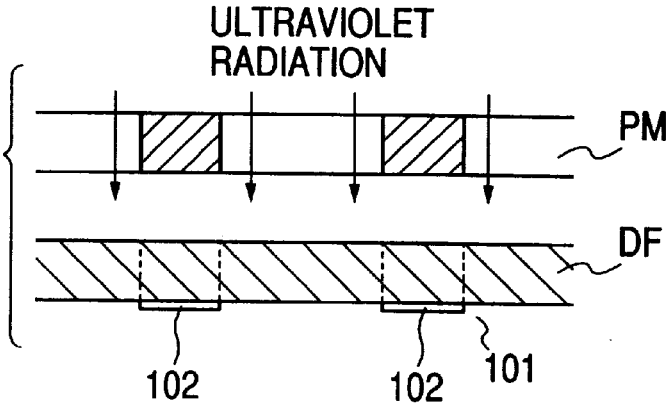

Next, as shown in FIG. 16C, a photomask PM was disposed on the dry film DF, and an ultraviolet ray was applied to that portion of the dry film DF which was left as a second liquid path wall through the photomask PM. This exposing step was effected by the use of MPA-600 produced by Canon Inc., with an exposure amount of about 600 $mJ/cm^2$.

Figure 16D:
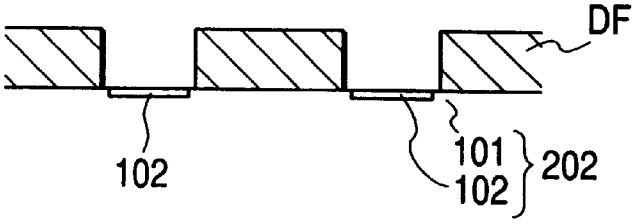

Next, as shown in FIG. 16D, the dry film DF was developed by developing liquid (produced by Tokyo Ohka: BMRC-3) comprising a mixture of xylene and butyl cell solve acetate to thereby melt the unexposed portion thereof, and a portion exposed and hardened was formed as the wall portion of the second liquid flow path 116. Further, residue left on the surface of the element substrate 101 was treated for about 90 seconds and eliminated by an oxygen plasma ashing apparatus (produced by Alkantech Co.: MAS-800), and subsequently was subjected to the application of ultraviolet ray of 100 $mJ/cm^2$ at 1500 for two hours to thereby harden the exposed portion completely.

Figure 19:
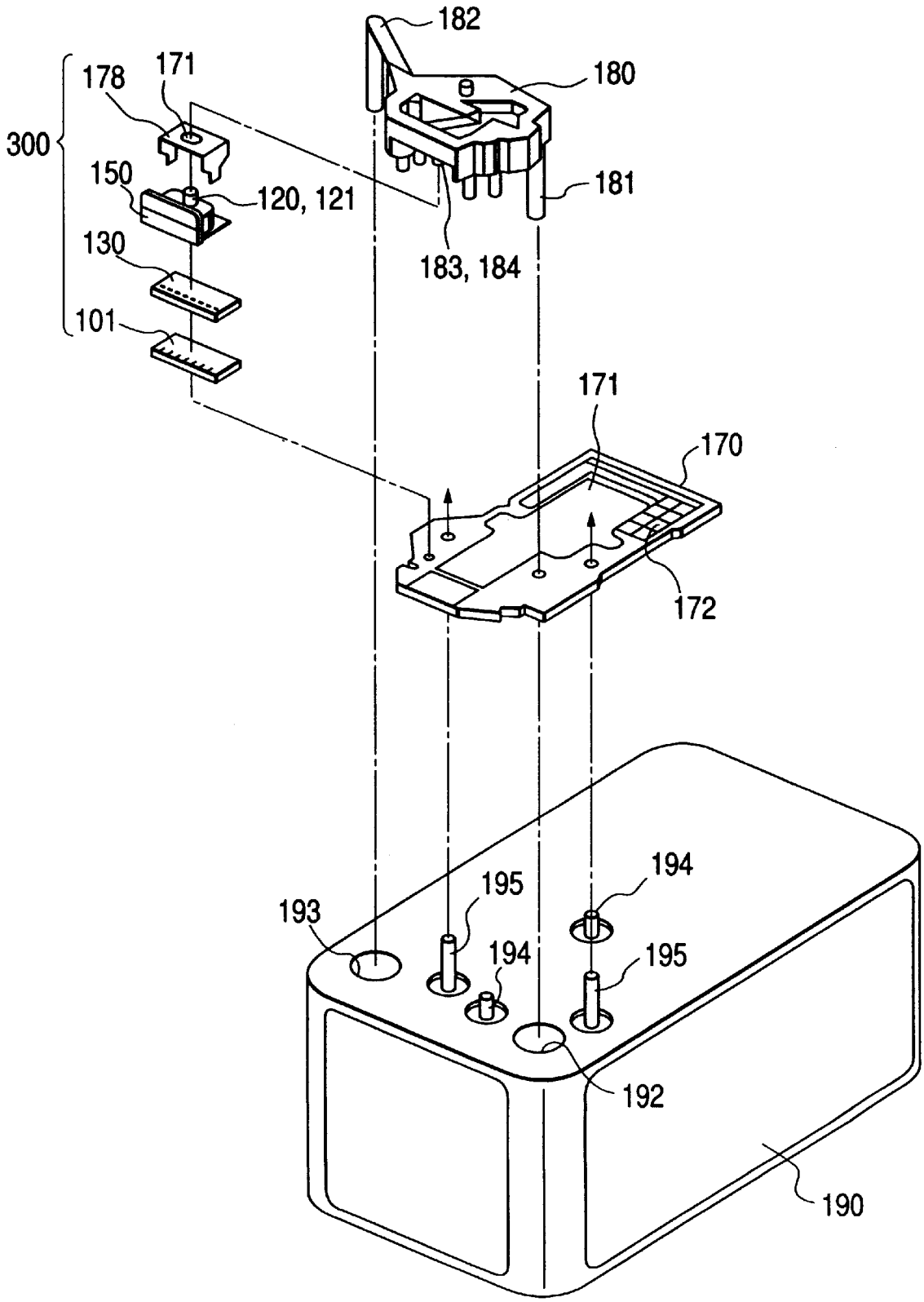
FIG. 19 is an exploded perspective view of the liquid discharging head cartridge of the present invention.

By the above-described method, the second liquid flow path can be uniformly accurately formed in a plurality of heater boards (element substrates) divided and made from the silicon substrate. The silicon substrate was cut and separated into heater boards 101 by a dicing machine (produced by Tokyo Seimitsu: AWD-4000) having a diamond plate of a thickness 0.05 mm mounted thereon. The separated heater boards 101 were fixed onto an aluminum base plate 170 by an adhesive agent (produced by Toray: SE4400) (FIG. 19). Then, a printed wiring base plate 171 joined in advance onto the aluminum base plate 170 and the heater boards 101 were connected together by an aluminum wire (not shown) of a diameter 0.05 mm.

Figure 16E:
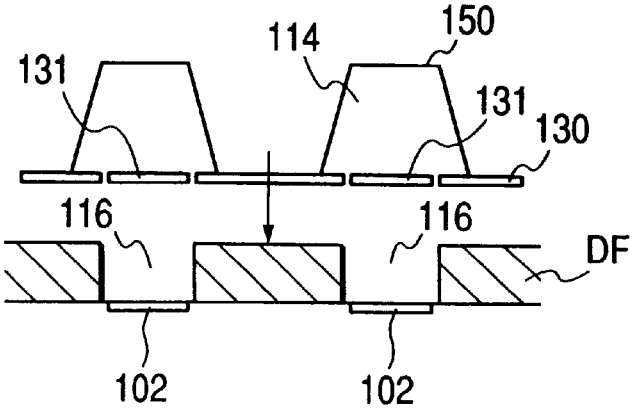

Next, as shown in FIG. 16E, a joined member of the grooved member 150 and the separating wall 130 was positioned and joined to the thus provided heater boards 101 by the above-described method. That is, the grooved member having the separating wall 130 and the heater boards 101 were positioned, and were brought into engagement with each other and fixed by a hold-down spring 178, whereafter a supply member 180 for ink and bubble creating liquid was joined and fixed to the aluminum base plate 170, and the gaps between aluminum wires and among the grooved member 150 and the heater boards 101 and the supply member 180 for ink and bubble creating liquid were sealed by a silicone sealant (produced by Toshiba Silicone: TSE399) to thereby complete the second liquid flow path.

By forming the second liquid flow path by the above-described manufacturing method, there can be obtained a flow path of good accuracy free of any positional deviation relative to the heater of each heater board. Particularly, by joining the grooved member 150 and the separating wall 130 together in advance at the previous step, the positional accuracy of the first liquid flow path 114 and the movable member 131 can be enhanced.

By the highly accurate manufacturing technique for these, the stabilization of the discharge is achieved and the quality of printing is improved. Also, it is possible to form the second liquid flow paths collectively on a wafer and therefore, it is possible to manufacture a great deal at a low cost.

In the present embodiment, dry film of the ultraviolet ray hardened type was used to form the second liquid flow path, but it is also possible to use resin having an absorbing band in the ultraviolet area, particularly, in the vicinity of 248 nm, laminate it and thereafter harden it, and directly remove the resin of the portion which provides the second liquid flow path by an excimer laser to thereby obtain the second liquid flow path.

FIGS. 17A to 17D are schematic cross-sectional views for illustrating a second embodiment of the method of manufacturing the liquid discharging head of the present invention.

Figure 17A:
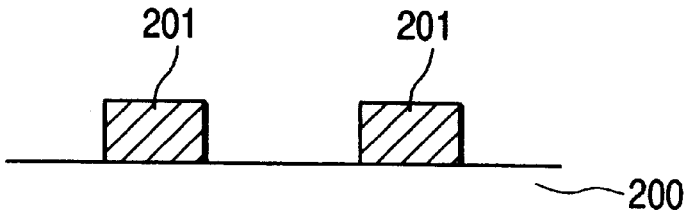
FIGS. 17A, 17B, 17C and 17D are step views for illustrating a method of manufacturing the liquid discharging head of the present invention.
Figure 17B:
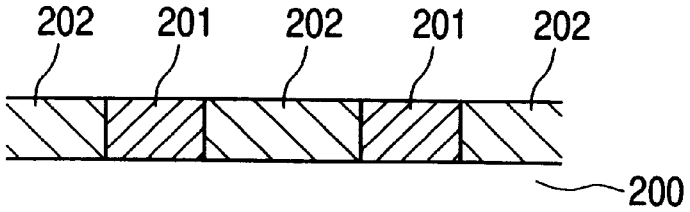

In the present embodiment, as shown in FIG. 17A, resist 201 having a thickness of 15 $\mu$m was patterned in the shape of the second liquid flow path on an SUS substrate 200.

Next, electric plating was effected on the SUS substrate 200 to thereby grow a nickel layer 202 also to a thickness of 15 $\mu$m on the SUS substrate 200. As the plating liquid, use was made of sulfamic nickel, a stress decreasing agent (produced by World Metal Co.: Zero All), boric acid, a pit preventing agent (produced by World Metal Co.: NP-APS) and nickel chloride. As the manner of applying an electric field during electrodeposition, an electrode on the anode side was attached and an already patterned SUS substrate 200 was mounted on the cathode side, and the temperature of the plating liquid was 500° C., and the current density was 5 A/cm$^2$.

Figure 17C:
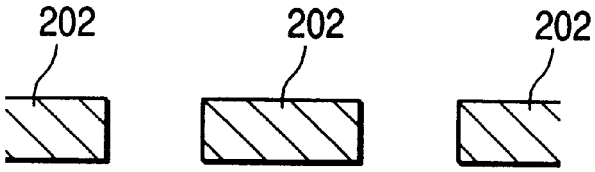

Next, as shown in FIG. 17C, ultrasonic vibration was given to the SUS substrate 200 on which the plating was completed as described above, and the portion of a nickel layer 202 was peeled from the SUS substrate 200 to thereby provide a desired second liquid flow path.

Figure 17D:
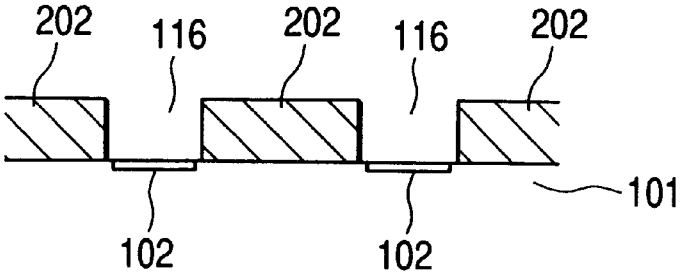

On the other hand, a heater board on which an electrothermal conversion element was disposed was formed on a silicon wafer by the use of a manufacturing apparatus similar to that for semiconductors. This wafer was separated into heater boards by a dicing machine as in the previous embodiment. These heater boards 101 were joined to an aluminum base plate 170 to which a printed substrate 204 was joined in advance, and a printed substrate 171 and an aluminum wire (not shown) were connected together to thereby form electrical wiring. As shown in FIG. 17D, the second liquid flow path provided by the aforedescribed step was positioned and fixed onto the heater boards 101 in such a state. In case of this fixing, the second liquid flow path is brought into engagement and close contact with a top plate having a separating wall similar to that in the first embodiment at the post-step by a hold-down spring and therefore, it will suffice if the second liquid flow path is fixed during the joining of the top plate to such an extent that no positional deviation may occur.

In the present embodiment, an ultraviolet ray hardened type adhesive agent (produced by Grace Japan: Amicon UV-300) was applied for said positioning and fixing, and by the use of an ultraviolet ray applying apparatus, the fixing was completed within about 3 seconds with the exposure amount as 100 mJ/cm$^2$.

According to the manufacturing method of the present embodiment, a highly accurate second liquid flow path free of any positional deviation relative to the heat generating member can be provided and in addition, the flow path wall is formed of nickel and therefore, it becomes possible to provide a highly reliable head strong against to alkaline liquid.

FIGS. 18A to 18D are schematic cross-sectional views for illustrating a third embodiment of the method of manufacturing the liquid discharging head of the present invention.

Figure 18A:
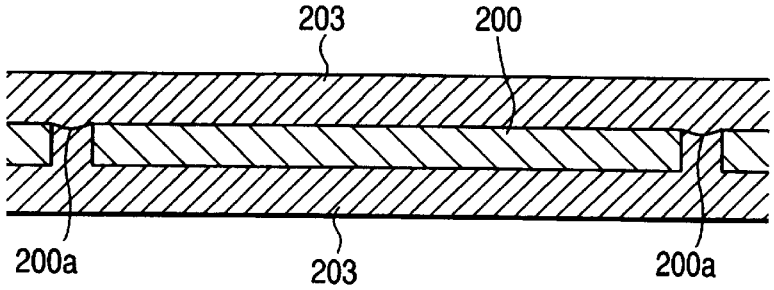
FIGS. 18A, 18B, 18C and 18D are step views for illustrating a method of manufacturing the liquid discharging head of the present invention.

In the present embodiment, as shown in FIG. 18A, resist 131 was applied to the both surfaces of an SUS substrate 200 of a thickness 15 pm having alignment apertures or marks 200*a*. As the resist, use was made of PMERP-AR900 produced by Tokyo Ohka.

Figure 18B:
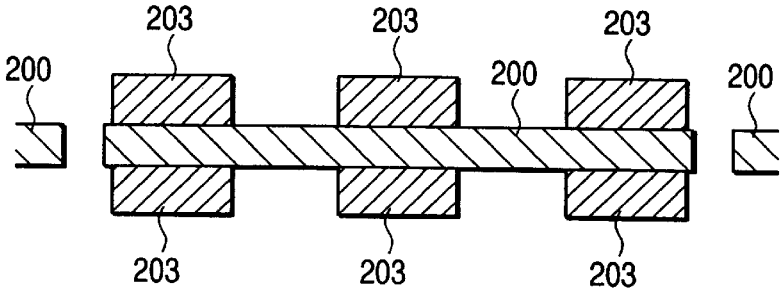

Thereafter, as shown in FIG. 18B, an exposure apparatus (produced by Canon Inc.: MPA-600) was used to expose the SUS substrate in accordance with the alignment apertures 200*a* of the element substrate 200, thereby removing the resist 203 in the portions in which the second liquid flow path is to be formed. The exposure was effected at 800 mJ/cm$^2$.

Figure 18C:
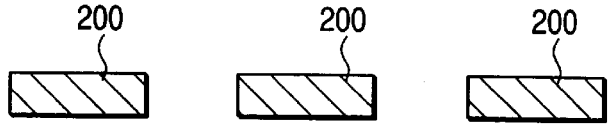

Next, as shown in FIG. 18C, the SUS substrate 200 on which the resist on the both surfaces was patterned was immersed in etching liquid (a water solution of ferric chloride or cupric chloride), and the portions exposed from the resist 203 were etched, whereafter the resist was peeled.

Figure 18D:
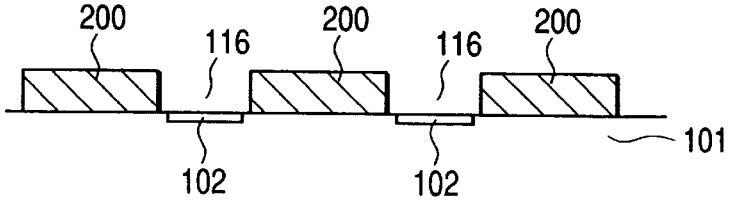

Next, as shown in FIG. 18D, as in the previous embodiment of the manufacturing method, the etched SUS substrate 200 was positioned and fixed on the heater board 101 and a liquid discharging head having the second liquid flow path 104 was assembled.

According to the manufacturing method of the present embodiment, there can be provided a highly accurate second liquid flow path 104 free of any positional deviation relative to the heater and in addition, the flow path is formed of SUS and therefore, there can be provided a highly reliable liquid discharging head strong against acid and alkaline liquid.

As described above, according to the manufacturing method of the present embodiment, the wall of the second liquid flow path is disposed in advance on the element substrate, whereby it becomes possible to position the electrothermal converting member and the second liquid flow path highly accurately. Also, second liquid flow paths can be formed at time on a number of element substrates on the substrate before cut or separated and therefore, there can be provided a great deal of low cost liquid discharging heads.

Also, in the liquid discharging head provided by carrying out the manufacturing method of the present embodiment for the liquid discharging head, the heat generating member and the second liquid flow path are highly accurately positioned and therefore, the head can efficiently receive the pressure of bubble creation by the heat generation of the electrothermal converting member, and becomes excellent in discharge efficiency.

<Liquid Discharging Head Cartridge>

Description will now be roughly made of a liquid discharging head cartridge carrying thereon the liquid discharging head according to the above-described embodiments.

Referring to FIG. 19 which is a typical exploded perspective view of a liquid discharging head cartridge including the aforedescribed liquid discharging head, the liquid discharging head cartridge is generally comprised of a liquid discharging head portion 300 and a liquid container 180.

The liquid discharging head portion 300 comprises an element substrate, a separating wall 130, a grooved member 150, a hold-down spring 178, a liquid supplying member 190, a support member 170, etc. A plurality of heat generating resistance members for giving heat to bubble creating liquid as previously described are provided in a row on the element substrate 101, and a plurality of functional elements for selectively driving these heat generating resistance members are also provided. A bubble creating liquid path is formed between the element substrate 101 and the separating wall 130 having a movable wall and the bubble creating liquid flows therethrough. By the joining of the separating wall 130 and the grooved top plate 150, there is formed a discharge flow path (not shown) through which discharge liquid flows.

The hold-down spring 178 is a member for causing a biasing force toward the element substrate 101 to act on the grooved member 150, and by this biasing force, the element substrate 101, the separating wall 130, the grooved member 150 and the support member 170 which will be described later are well made into a unit.

The support member 170 is for supporting the element substrate 101, etc., and on this support member 170, there are further disposed a circuit substrate 171 connected to the element substrate 101 for supplying an electrical signal, and a contact pad 172 connected to the apparatus side for exchanging an electrical signal with the apparatus side.

The liquid container 190 separately contains therein discharged liquid such as ink supplied to the liquid discharging head and bubble creating liquid for creating a bubble therein. Outside the liquid container 190, there are provided a positioning portion 194 for disposing a connecting member for effecting the connection of the liquid discharging head and the liquid container, and a fixing shaft 195 for fixing the connecting member. The discharged liquid is supplied from the discharged liquid supply path 192 of the liquid container to the discharged liquid supply path 181 of the liquid supplying member 180 through the supply path 184 of the connecting member, and is supplied to a first supply liquid chamber through the discharged liquid supply paths 183, 171 and 121 of the respective members. Likewise, the bubble creating liquid is supplied from the supply path 193 of the liquid container to the bubble creating liquid supply path 182 of the liquid supplying member 180 through the supply path of the connecting member, and is supplied to a second liquid chamber through the bubble creating liquid supply paths 184, 171 and 122 of the respective members.

In the above-described liquid discharging head cartridge, a case where the bubble creating liquid and the discharged liquid are different liquids has also been described with respect to a state of supply and a liquid container in which supply can be effected, but when the discharged liquid and the bubble creating liquid are the same, the supply routes and container for the bubble creating liquid and discharged liquid need not be divided.

The liquid container may be refilled with liquids after the consumption of each liquid and used. For this purpose, the liquid container may desirably be provided with a liquid inlet port. Also, the liquid discharging head and the liquid container may be integral with each other or separable from each other.

<Liquid Discharging Apparatus>

Figure 20:
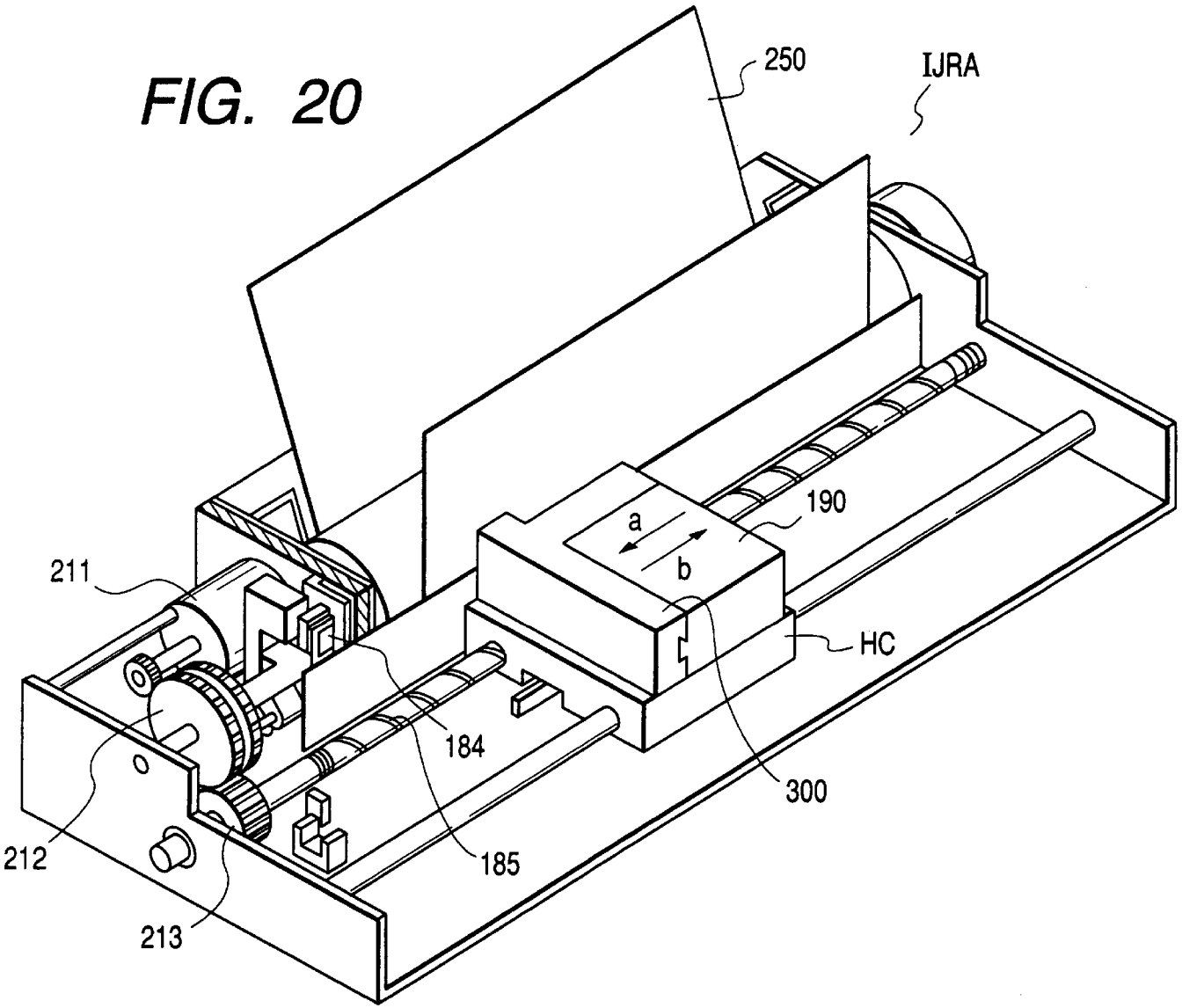
FIG. 20 schematically shows the construction of the liquid discharging apparatus of the present invention.

FIG. 20 schematically shows the construction of a liquid discharging apparatus carrying the above-described liquid jet head thereon. In the present embodiment, description will be made of an ink discharge recording apparatus using ink particularly as discharged liquid. The carriage HC of the liquid discharging apparatus carries thereon a head cartridge on which a liquid tank portion 190 containing ink therein and a liquid discharging head portion 300 are removably mountable, and is reciprocally movable in the widthwise direction of a recording medium 250 such as recording paper conveyed by recording medium conveying means.

When a driving signal is supplied from driving signal supplying means to liquid discharging means on the carriage, recording liquid is discharged from the liquid discharging head to the recording medium in conformity with this signal.

Also, the liquid discharging apparatus of the present embodiment has a motor 211 as a drive source for driving the recording medium conveying means and the carriage, gears 212 and 213 for transmitting the power from the drive source to the carriage, a carriage shaft 215, etc. By this recording apparatus and a liquid discharging method carried out by this recording apparatus, liquid was discharged to various recording mediums, whereby a good record of image could be obtained.

Figure 21:
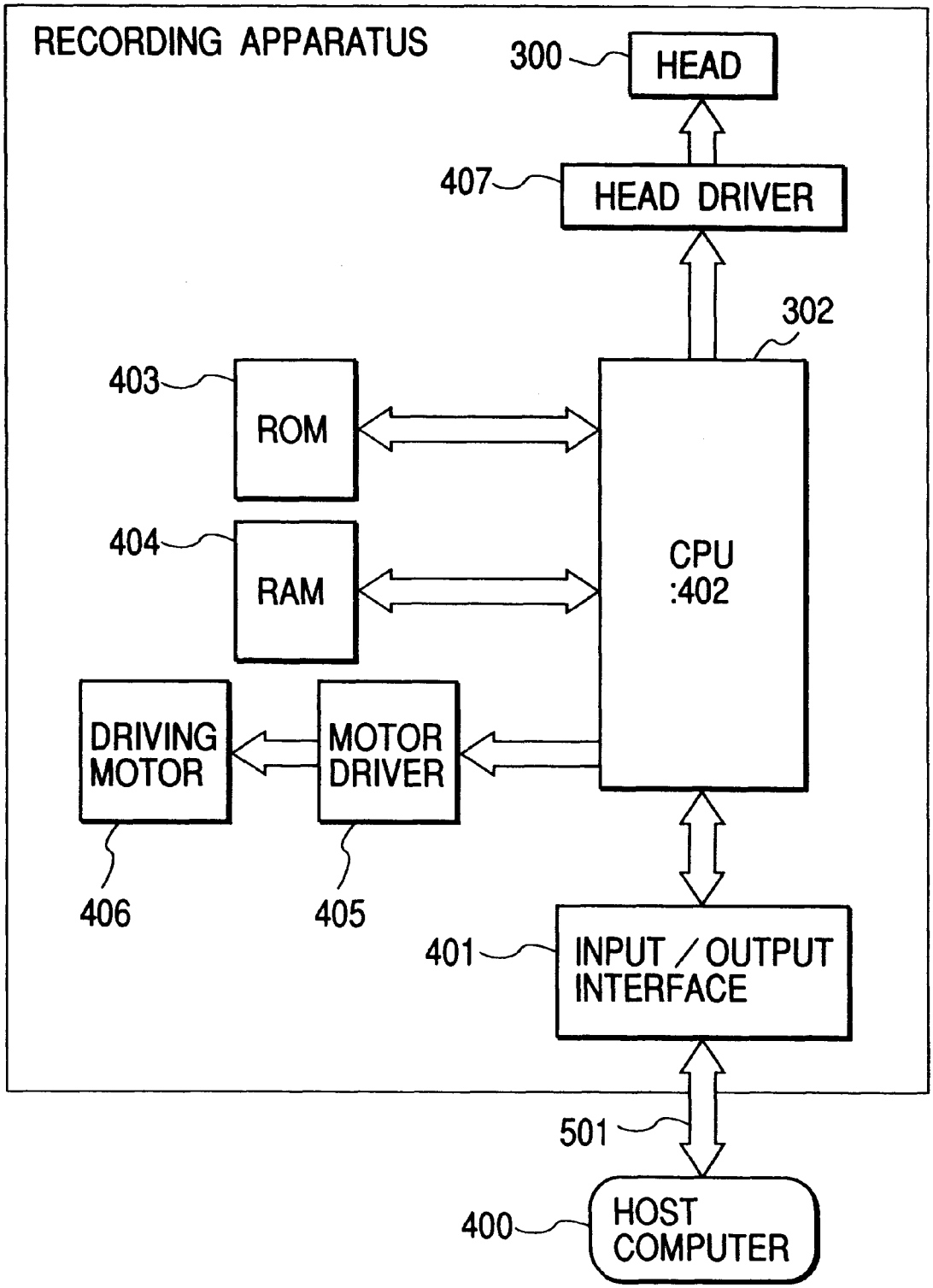
FIG. 21 is a block diagram of the apparatus.

FIG. 21 is a block diagram of an entire apparatus for operating ink discharge recording to which the liquid discharging method and liquid discharging head of the present invention are applied.

The recording apparatus receives printing information as a control signal from a host computer 400. The printing information is temporarily preserved in an input interface 401 in the printing apparatus and at the same time, it is converted into data treatable in the recording apparatus, and is inputted to a CPU 402 serving also as head driving signal supplying means. The CPU 402 processes the data inputted to the CPU 402 by the use of a peripheral unit such as a RAM 404, on the basis of a control program preserved in a ROM 403, and converts it into data (image data) to be printed.

Also, the CPU 402 makes driving data for driving a driving motor for moving recording paper and a recording head in synchronism with the image data in order to record the image data at a suitable position on the recording paper. The image data and motor driving data are transmitted to the head 300 and the driving motor 406 through a head driver 407 and a motor driver 405 to thereby form an image driven at controlled timing.

Recording mediums which are applicable to the recording apparatus as described above and to which liquid such as ink is imparted include various kinds of paper, OHP sheets, plastic materials used in compact disc decoration plates or the like, fabrics, metallic materials such as aluminum and copper, leather materials such as oxhide, pigskin and artificial leather, wood such as timber and plywood, bamboo materials, ceramic materials such as tiles, three-dimensional structures such as sponges, etc.

Also, the above-described recording apparatuses include a printer apparatus for effecting recording on various kinds of paper, OHP sheets, etc., a recording apparatus for plastics for effecting recording on plastic materials such as compact discs, a recording apparatus for metals for effecting recording on metallic plates, a recording apparatus for leather for effecting recording on leather, a recording apparatus for wood for effecting recording on wood, a recording apparatus for ceramics for effecting recording on ceramic materials, a recording medium for effecting recording on three-dimensional net-like structures such as sponges, a textile printing apparatus for effecting printing on textiles, etc.

Also, as the discharged liquid used in these liquid discharging apparatuses, use can be made of liquid matching the respective recording mediums and recording conditions.

<Recording System>

Description will now be made of an example of an ink jet recording system using the liquid discharging head of the present invention as a recording head to effect recording on a recording medium.

Figure 22:
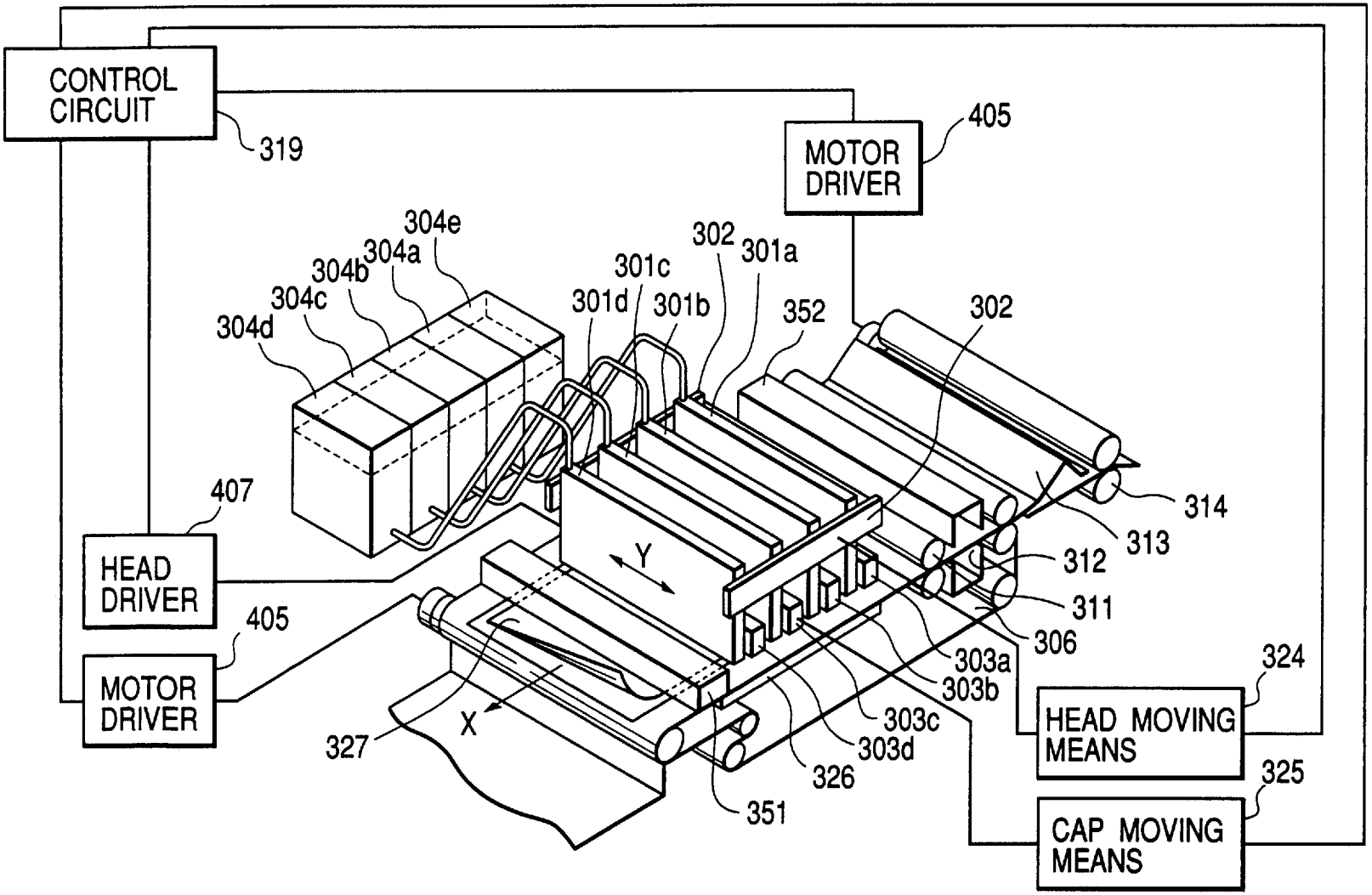
FIG. 22 shows a liquid discharging and recording system.

FIG. 22 is a typical view for illustrating the construction of an ink jet recording system using the aforedescribed liquid discharging head 301 of the present invention. The liquid discharging head in the present embodiment is a head of the full line type in which a plurality of discharge ports are disposed at intervals of 360 dpi over a length corresponding to the recordable width of a recording medium 250, and has four heads corresponding to four colors, i.e., yellow (Y), magenta (M), cyan (C) and black (Bk) fixed and supported in parallelism to one another at predetermined intervals in X direction by a holder 202.

A signal is supplied to these heads from a head driver 407 constituting driving signal supplying means, and each head is driven on the basis of this signal.

Inks of four colors Y, M, C and Bk are supplied from ink containers 304*a* to 304*d* to the respective heads. The reference character 304*e* designates a bubble creating liquid container storing bubble creating liquid therein, and the bubble creating liquid may be supplied from this container to each head.

Head caps 303*a* to 303*d* having ink absorbing members such as sponges disposed therein are provided below the respective heads, and the discharge ports of the heads are covered during recording, whereby the maintenance of the heads can be accomplished.

The reference numeral 306 denotes a conveying belt constituting conveying means for conveying the various kinds of recording mediums as described in the previous embodiments. The conveying belt 306 is guided along a predetermined route by various rollers, and is driven by a driving roller connected to a motor driver 405.

In the ink jet recording system of the present embodiment, a pre-processing apparatus 351 and a post-processing apparatus 352 for effecting various kinds of processing on the recording medium before and after recording is effected are provided upstream and downstream, respectively, of a recording medium conveyance route.

The pre-processing and the post-processing differ in their substance from each other in conformity with the kind of the recording medium on which recording is effected and the kind of the ink, and for example, for recording mediums such as metals, plastics and ceramics, the application of ultraviolet rays and ozone is effected as the pre-processing to activate the surface thereof, whereby an improvement in the adhering property of the inks can be achieved. Also, in the case of recording mediums such as plastics which are liable to produce static electricity, dust is liable to adhere to the surfaces thereof due to the static electricity and good recording may be hampered by such dust. Therefore, as the pre-processing, the static electricity of the recording medium can be removed by the use of an ionizer device to thereby remove the dust from the recording medium. Also, when a textile is used as the recording medium, the process of imparting to the textile a substance chosen from among alkaline substances, water-soluble substances, synthetic high molecules, water-soluble metal salt, urea and thiourea can be carried out as the pre-processing from the viewpoints such as the prevention of blotting and improvement in the degree of exhaustion. The pre-processing is not limited thereto, but may be the process of making the temperature of the recording medium appropriate for recording.

On the other hand, the post-processing is the fixating process of promoting the fixation of inks by heat treatment or the application of ultraviolet rays to a recording medium to which inks were imparted, or the process of washing away a processing agent imparted in the pre-processing and left unreacted.

In the present embodiment, the head has been described as a full line head, whereas this is not restrictive, but the head may be in the form of a compact head which is conveyed in the widthwise direction of the recording medium to thereby effect recording.

As described above, in the present invention, provision is made of negative pressure acting means for causing negative pressure to act in the first liquid flow path with the disappearance of the second bubble created in the second bubble creating area and therefore, if a second bubble is created in the second bubble creating area and thereafter, the created second bubble is caused to disappear, negative pressure will act in the first liquid flow path, whereby the meniscus in the discharge port retreats. By this retreat of the meniscus, the amount of liquid present between the first bubble and the meniscus becomes smaller, and the amount of liquid discharged from the discharge port can be decreased. By the use of this mechanism, the amount of liquid discharged from the discharge port can be controlled by the negative pressure acting means.

What is claimed is:

1. A liquid discharging method of discharging liquid from a discharge port by a liquid discharging element in a first liquid flow path communicating with said discharge port for supplying said liquid to said discharge port, said method comprising the steps of:

using a movable member for causing negative pressure to act on said first liquid flow path; and providing said movable member displaceable with respect to said first liquid flow path only by disappearance of a bubble, wherein said negative pressure is caused to act by the displacement of said movable member, and said movable member is displaced in a direction away from said first liquid flow path by the disappearance of said bubble.

2. A liquid discharging method according to claim 1, wherein said movable member is a movable valve having a free end on said discharge port side.

3. A liquid discharging method according to claim 1, wherein said movable member is movable film constituting a portion of a flow path wall of said first liquid flow path.

4. A liquid discharging method according to claim 1, wherein said movable member is displaced at predetermined timing.

5. A liquid discharging method according to claim 4, characterized in that said movable member is displaced in a state in which the liquid is discharged from said discharge port.

6. A liquid discharging method according to claim 4, wherein said movable member is displaced based on the displacement of the meniscus of the liquid in said discharge port.

7. A liquid discharging method of discharging liquid from a discharge port by a liquid discharging element in a first liquid flow path communicating with said discharge port for supplying said liquid to said discharge port, said method comprising the steps of:

using a movable member for causing negative pressure to act on said first liquid flow path:

providing said movable member displaceable with respect to said first liquid flow path only by disappearance of a bubble, wherein said negative pressure is caused to act by the displacement of said movable member, and said movable member is displaced in a direction away from said first liquid flow path by the disappearance of said bubble; and detecting presence/absence of the liquid using a detecting means provided near said discharge port, and the detection result in a state in which said movable member is not displaced and the detection result in a state in which said movable member is displaced are compared with each other to thereby detect the presence/absence of the liquid.

8. A liquid discharging head comprising:

a discharge port for discharging liquid therethrough;

a first bubble creating area for creating a first bubble in the liquid;

a first liquid flow path provided with said first bubble creating area and communicating with said discharge port, the liquid in said first liquid flow path being discharged through said discharge port by creation of said first bubble;

a second bubble creating area for creating a second bubble in the liquid;

a second liquid flow path provided with said second bubble creating area; and negative pressure acting means using a movable member provided between said first liquid flow path and said second liquid flow path for causing only negative pressure to act in said first liquid flow path by the disappearance of said second bubble, wherein said negative pressure acting means is displaced in a direction away from said first liquid flow path by disappearance of said second bubble.

9. A liquid discharging head according to claim 8, characterized in that said negative pressure acting means is a movable valve having a free end on said discharge port side.

10. A liquid discharging head according to claim 8, wherein said movable member is movable film constituting a portion of a flow path wall of said first liquid flow path.

11. A liquid discharging head according to claim 8, characterized in that said second bubble creating area and said negative pressure acting means are provided upstream of said first bubble creating area.

12. A liquid discharging head according to claim 8, wherein said second bubble creating area, said negative pressure acting means and said first bubble creating area are disposed laterally with respect to a direction of flow of the liquid.

13. A head cartridge characterized by:

a liquid discharging head according to claim 8; and a liquid container holding therein liquid to be supplied to said liquid discharging head.

14. A head cartridge according to claim 13, characterized in that said liquid discharging head and said liquid container are separable from each other.

15. A head cartridge according to claim 13, characterized in that said liquid container can be refilled with said liquid.

16. A liquid discharging apparatus comprising:

a liquid discharging head according to any one of claims 8 and 9–13; and driving signal supplying means for supplying a driving signal for discharging liquid from said liquid discharging head.

17. A liquid discharging apparatus comprising:

a liquid discharging head according to any one of claims 8 and 9–13; and recording medium conveying means for conveying a recording medium receiving the liquid discharged from said liquid discharging head.

* * * * *

UNITED STATES PATENT AND TRADEMARK OFFICE

CERTIFICATE OF CORRECTION

PATENT NO. : 6,199,556 B1
DATED : March 13, 2001
INVENTOR(S) : Benetti et al.

It is certified that error appears in the above-identified patent and that said Letters Patent is hereby corrected as shown below:

Column 3,
Line 25, delete “to”.
Line 26, delete “a”.

Column 10,
Line 29, delete “of the”.

Signed and Sealed this

Twenty-fifth Day of June, 2002

*Attest:*

*Attesting Officer*

JAMES E. ROGAN
*Director of the United States Patent and Trademark Office*